US012595668B2

(12) United States Patent
Ono et al.

(10) Patent No.: US 12,595,668 B2
(45) Date of Patent: Apr. 7, 2026

(54) HANGING SCAFFOLD

(71) Applicant: Dai Ono, Chiba (JP)

(72) Inventors: Dai Ono, Tokyo (JP); Tatsuo Kurisu, Tokyo (JP)

(73) Assignee: Dai Ono, Chiba (JP)

( * ) Notice: Subject to any disclaimer, the term of this patent is extended or adjusted under 35 U.S.C. 154(b) by 0 days.

(21) Appl. No.: 19/196,746

(22) Filed: May 2, 2025

(65) Prior Publication Data

US 2025/0369239 A1 Dec. 4, 2025

(30) Foreign Application Priority Data

Jun. 4, 2024 (JP) ..... 2024-090879

(51) Int. Cl.
*E04G 3/30* (2006.01)

(52) U.S. Cl.
CPC ..... *E04G 3/30* (2013.01)

(58) Field of Classification Search
CPC ..... E04G 1/15; E04G 3/30; A47B 43/006; E04B 9/20
See application file for complete search history.

(56) References Cited

U.S. PATENT DOCUMENTS 1,606,289 A * 11/1926 Bowers ..... E04B 9/20 52/331
2,556,105 A * 6/1951 Rhett ..... A47B 43/006 108/106
4,068,738 A * 1/1978 Reed ..... E04G 3/20 182/128
4,253,549 A * 3/1981 Petren ..... E04G 1/15 52/745.18
4,388,982 A * 6/1983 Yonahara ..... E04G 3/20 182/115
4,413,707 A * 11/1983 Lienhard, Sr. ..... E04G 3/30 182/150

(Continued)

FOREIGN PATENT DOCUMENTS

JP 2023-117755 A 8/2023

OTHER PUBLICATIONS

Sep. 3, 2024, Japanese Decision to Grant a Patent issued for related JP Application No. 2024-090879.

*Primary Examiner* — Colleen M Chavchavadze
(74) *Attorney, Agent, or Firm* — Paratus Law Group, PLLC

(57) ABSTRACT

It is characterized in that a scaffolding member having a work floor; a chain formed by connecting a plurality of annular-shaped chain elements in a row and suspending the scaffolding member; and a chain coupling device installed in the scaffolding member and coupling the chain to the scaffolding member are included, in which when a side facing a hole of the chain element is a front side, a width of the chain element viewed from the front side is a lateral width, and a width of the chain element viewed from a side is a vertical width, the chain coupling device includes: a cylindrical body in which an axis is along a vertical direction and the chain is inserted inside; and a stopper that has a notch with a width narrower than the lateral width of the chain element and wider than the vertical width of the chain element and abuts on a lower end of the cylindrical body.

5 Claims, 16 Drawing Sheets

(56) References Cited

U.S. PATENT DOCUMENTS

| | | | | |
|---|---|---|---|---|
| 4,732,235 | A * | 3/1988 | Reed | E04G 3/20 182/152 |
| 5,397,090 | A * | 3/1995 | Carson | E04B 9/20 52/506.07 |
| 9,080,695 | B2 * | 7/2015 | Magno, Jr. | F16L 3/227 |
| 11,261,610 | B1 * | 3/2022 | Apostolopoulos | E04G 3/30 |
| 2020/0031635 | A1 * | 1/2020 | Hernandez Ortiz | B66C 15/00 |

* cited by examiner

HANGING SCAFFOLD

CROSS REFERENCE TO PRIOR APPLICATION

This application claims priority to Japanese Patent Application No. 2024-090879 (filed on Jun. 4, 2024), which is hereby incorporated by reference in its entirety.

BACKGROUND

Technical Field

The present invention relates to a hanging scaffold.

Related Art

As the conventional hanging scaffold, for example, there is one that is suspended from a building or a structure by a chain and is used in construction or maintenance work of the building or the structure.

For example, a hanging scaffold disclosed in JP 2023-117755 A includes a plurality of beam members arranged in parallel in a depth direction and a width direction, a scaffolding member having a joint connecting end portions of the beam members, and a work floor installed between the beam members, in which a lower end of a chain suspended from a building, a construction, or the like is connected to the joint.

Specifically, the joint has a cylindrical body whose axis is along the vertical direction and which allows the chain to be inserted therein, and a pair of through holes facing each other in the radial direction are formed in the cylindrical body. Then, the chain is inserted into the cylindrical body and a pin is inserted into the through hole of the cylindrical body and the chain element constituting the chain, whereby the chain is connected to the cylindrical body of the joint and the scaffolding member is suspended.

SUMMARY

However, as described above, when the pin is inserted into the chain element of the chain and the through hole of the cylindrical body to connect the chain to the cylindrical body, it is necessary to adjust the position of the chain element in the vertical direction and the orientation of the chain element in the circumferential direction so that the inner side of the chain element faces the through hole of the cylindrical body. Therefore, it is troublesome to connect the chain to the scaffolding member.

Therefore, an object of the present invention is to provide a hanging scaffold capable of easily connecting a chain to a scaffolding member.

In order to achieve the above object, a hanging scaffold of the present invention includes: a scaffolding member having a work floor; a chain formed by connecting a plurality of annular-shaped chain elements in a row and suspending the scaffolding member; and a chain coupling device installed in the scaffolding member and coupling the chain to the scaffolding member, in which when a side facing a hole of the chain element is a front side, a width of the chain element viewed from the front side is a lateral width, and a width of the chain element viewed from a side is a vertical width, the chain coupling device includes: a cylindrical body in which an axis is along a vertical direction and the chain is inserted inside; and a stopper that has a notch with a width narrower than the lateral width of the chain element and wider than the vertical width of the chain element and abuts on a lower end of the cylindrical body. According to this configuration, the chain can be connected to the cylindrical body simply by slidingly moving the stopper in the lateral direction toward the chain side, inserting the chain element located below the lower end of the cylindrical body into the notch of the stopper, and pulling up the chain without adjusting the direction of the chain element and the position of the hole. Therefore, the chain can be easily connected to the scaffolding member. In addition, in the hanging scaffold of the present invention, since an upper surface of the stopper of the chain coupling device is brought into contact with the lower end of the cylindrical body to support the cylindrical body, the stopper can ensure sufficient strength without being limited by the size of the hole of the chain element, and thus, it is possible to ensure necessary strength according to the loading load required for the hanging scaffold. Therefore, according to the hanging scaffold of the present invention, the maximum loading load of the hanging scaffold can be increased, and the number of chains can also be reduced.

In addition, another hanging scaffold of the present invention includes: a scaffolding member having a work floor; a chain formed by connecting a plurality of annular-shaped chain elements in a row and suspending the scaffolding member; and a chain coupling device installed in the scaffolding member and coupling the chain to the scaffolding member, in which when a side facing a hole of the chain element is a front side, a width of the chain element viewed from the front side is a lateral width, and a width of the chain element viewed from a side is a vertical width, the chain coupling device includes: a cylindrical body in which an axis is along a vertical direction and the chain is inserted inside; a regulating portion having a notch with a width narrower than the lateral width of the chain element and wider than the vertical width of the chain element; and a connecting means that connects the regulating portion in a state of regulating movement in the vertical direction while allowing the lateral movement with respect to an upper end of the cylindrical body. According to this configuration, the chain can be connected to the cylindrical body simply by slidingly moving the stopper in the lateral direction toward the cylindrical body, connecting the regulating portion to the upper end of the cylindrical body by the connecting means, and inserting the chain element located near the upper end of the cylindrical body into the notch without adjusting the orientation of the chain element and the position of the hole. Therefore, the chain can be easily connected to the scaffolding member.

DETAILED DESCRIPTION

Figure 1:
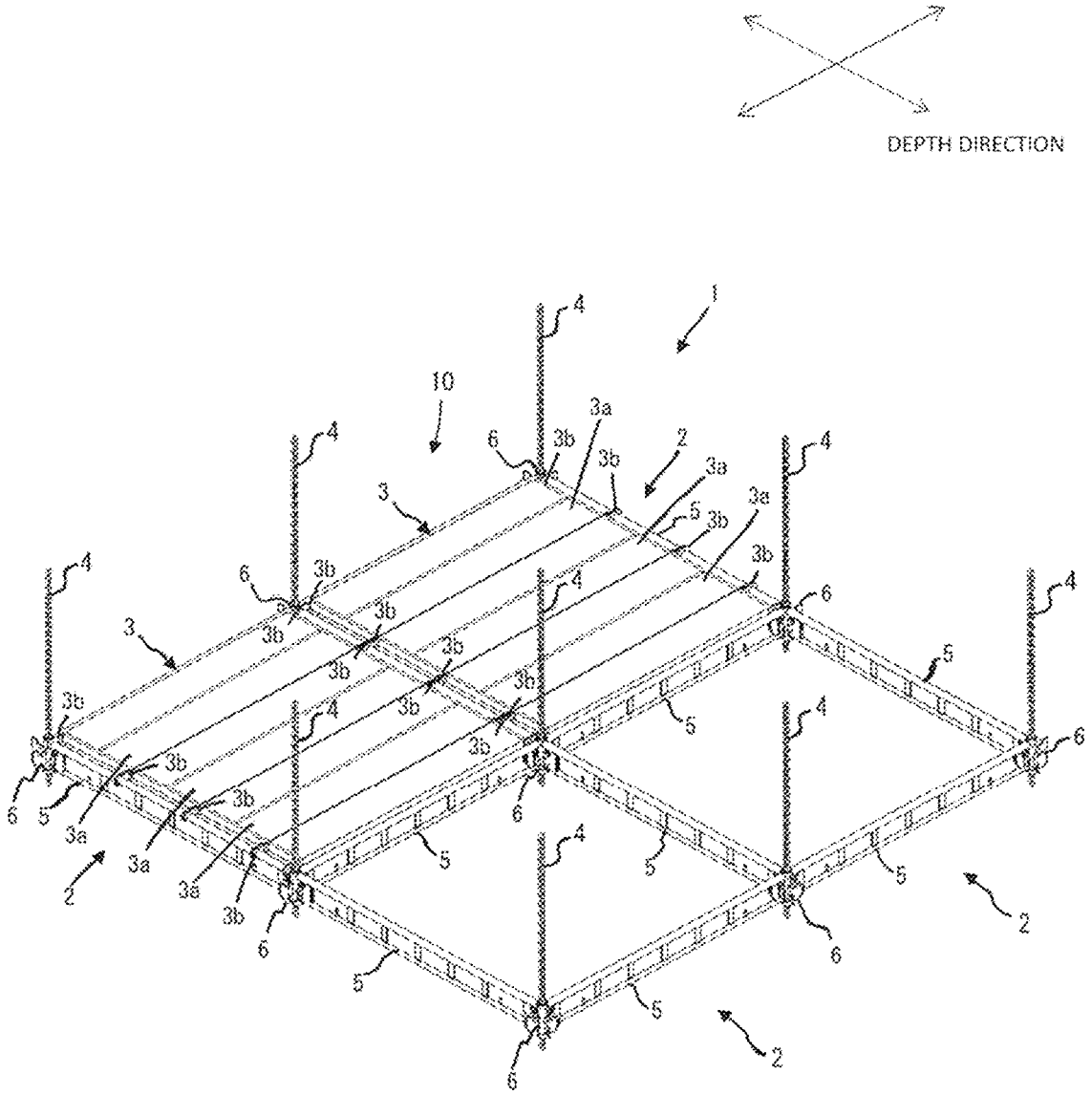
FIG. 1 is a perspective view illustrating a hanging scaffold of a first embodiment.

Hereinafter, the present embodiments will be described with reference to the drawings. The same reference numerals given throughout the several drawings indicate the same parts.

A hanging scaffold 1 according to a first embodiment of the present invention includes: a scaffolding member 10 having a work floor 3; a chain 4 formed by connecting a plurality of annular-shaped chain elements 4*a* in a row and suspending the scaffolding member 10; and a chain coupling device A installed on the scaffolding member 10 and coupling the chain 4 to the scaffolding member 10.

The scaffolding member 10 of the present embodiment includes a plurality of beam members 5 and 5 arranged in parallel, a joint 6 coupled to an end portion of the beam member 5, and the work floor 3 installed between the beam members 5 and 5.

In the present embodiment, as illustrated in FIG. 1, the scaffolding member 10 includes a plurality of frame bodies 2 formed by connecting a plurality of beam members 5 to each joint 6, and the work floor 3 including a plurality of scaffold boards 3*a* bridged between the beam members 5 and 5 of each frame body 2, in which each frame body 2 is connected and disposed in a depth direction and a width direction. In FIG. 1, the work floor 3 installed in some of the frame bodies 2 is omitted in order to facilitate understanding of the structure of the scaffolding member 10. In addition, although the hanging scaffold 1 illustrated in FIG. 1 includes four frame bodies 2 arranged in two rows in the width direction and two rows in the depth direction, the number of frame bodies 2 may be arbitrarily determined according to the floor area of the scaffolding member 10, and the number of frame bodies 2 may be one.

More specifically, the frame body 2 is formed in a quadrangular shape in plan view by two beam members 5 and 5 arranged in parallel along the depth direction, two beam members 5 and 5 arranged in parallel along the width direction, and four joints 6 connected to end portions of the beam members 5 by coupling pins 7 as connecting members to be described later and connecting the end portions of the beam members 5, and the frame bodies 2 adjacent to each other in the depth direction and the width direction share one beam member 5 at the center and the joint 6 connected to both ends of the beam member 5. In the present embodiment, the frame body 2 includes the two beam members 5 and 5 arranged in parallel along the depth direction and the two beam members 5 and 5 arranged in parallel along the width direction. However, when the two beam members 5 and 5 arranged in parallel along the depth direction are connected by the work floor 3 to function as a structure, the two beam members 5 and 5 arranged in parallel along the width direction may be omitted. In addition, the shape of the frame body 2 may also be a shape other than a square in plan view, for example, a rectangular shape or a parallelogram shape.

Figure 2:
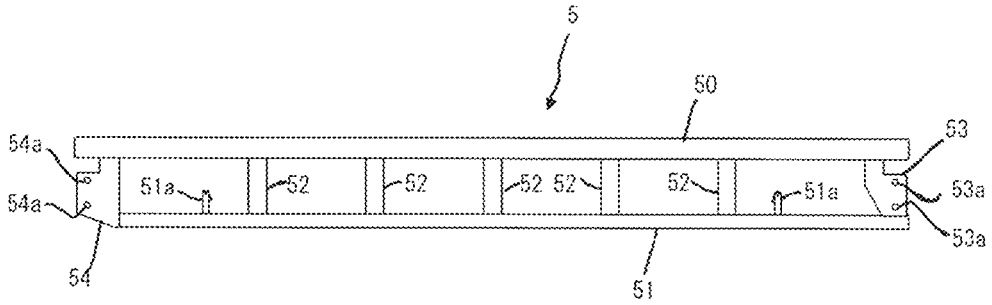
FIG. 2 is a side surface of a beam member in the hanging scaffold of the first embodiment.
Figure 3:
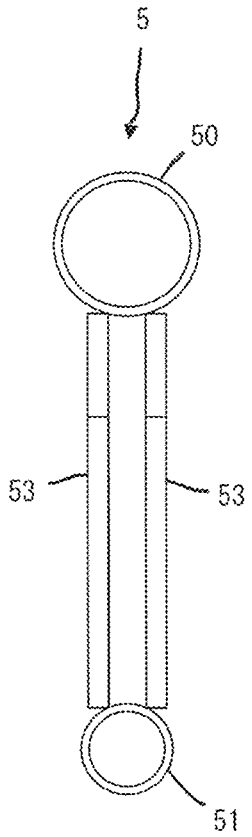
FIG. 3 is a front view of the beam member in the hanging scaffold of the first embodiment as viewed from one end side.

As illustrated in FIGS. 2 and 3, the beam member 5 includes a pair of upper and lower beam materials 50 and 51, a plurality of bundle members 52 bridging between the upper beam materials 50 and the lower beam materials 51 and connecting the beam materials 50 and 51, and a pair of left and right attachment pieces 53, 53, 54, and 54 having a flat plate shape extending along the vertical direction from a lower portion of each end portion of the upper beam material 50 and viewed from the axial direction. As described above, the beam member 5 of the present embodiment does not have a structure in which beam materials are arranged side by side, and thus has a compact structure in the width direction.

Further, as illustrated in FIG. 2, the lower beam material 51 is provided with pin-shaped fixing portions 51*a* and 51*a* protruding upward from upper portions at two positions on the left and right in the axial direction. Although not illustrated, by bridging brace members (not illustrated) diagonally across the fixing portions 51*a* and 51*a* between the lower beam materials 51 and 51 facing each other in the depth direction or the width direction in the frame body 2, the strength of the frame body 2 can be increased. However, if the strength of the frame body 2 is not insufficient even if the brace member is not installed, the fixing portion 51*a* for installing the brace member may be omitted.

The attachment piece 53 and the attachment piece 54 have the same structure except for a part. Specifically, in each of the attachment pieces 53 and 54, two pin holes 53*a*, 53*a*, 54*a*, and 54*a* arranged side by side along the vertical direction when viewed from the axial direction of the beam member 5 are formed so as to face each other in the left-right direction. In the present embodiment, the upper beam material 50 and the lower beam material 51 are formed in a cylindrical shape, but may have a shape other than the cylindrical shape, for example, a square cylindrical shape.

In the present embodiment, as illustrated in FIGS. 2 and 3, the attachment piece 53 provided on the right side in FIG. 2 (hereinafter, referred to as "one-end-side attachment piece 53"), which is one end side of the beam member 5, is bridged between a lower portion of the upper beam material 50 and an upper portion of the lower beam material 51, since the upper end and the lower end are connected to the upper beam material 50 and the lower beam material 51, respectively, the lower side of the gap between the one-end-side attachment pieces 53 and 53 is closed by the lower beam material 51. On the other hand, in the attachment piece 54 provided on the left side in FIG. 2 (hereinafter, referred to as "the other-end-side attachment piece 54"), which is the other end side of the beam member 5, since the right side surface in FIG. 2 at the lower end is connected to the left end surface in FIG. 2 of the lower beam material 51, the lower side of the gap between the other-end-side attachment pieces 54 and 54 is open. However, the lower side of the gap between the one-end-side attachment pieces 53 and 53 may be opened, and the lower side of the gap between the other-end-side attachment pieces 54 and 54 may be closed by the lower beam material 51. Alternatively, the lower side of both the gap between the one-end-side attachment pieces 53 and 53 and the gap between the other-end-side attachment pieces 54 and 54 may be opened or closed.

As illustrated in FIG. 1, the work floor 3 is configured with a plurality of rectangular plate-shaped scaffold boards 3*a* bridged between the upper beam materials 50 and 50 of the beam members 5 and 5 facing each other in the width direction in the frame body 2.

One hook 3*b* is provided at each of four corners at both ends in the longitudinal direction of each scaffold board 3*a*, and by hooking the hook 3*b* on the upper beam material 50 of the beam member 5, the scaffold board 3*a* is bridged between the upper beam materials 50 and 50 of the beam members 5 and 5 facing each other in the width direction. Although not illustrated, the hook 3*b* provided at one end in the longitudinal direction of the scaffold board 3*a* and the hook 3*b* provided at the other end are arranged so as to be shifted from each other in the lateral direction of the scaffold board 3*a*. Therefore, when the scaffold boards 3*a* are installed in the frame bodies 2 and 2 adjacent to each other in the width direction, the hooks 3*b* of the scaffold boards 3*a* of the adjacent frame bodies 2 and 2 are hooked on the central beam member 5, but the hooks 3*b* and 3*b* of each work floor 3 are arranged so as to be staggered on the central beam member 5 shared by the frame bodies 2 and 2 adjacent to each other in the width direction, so that the hooks 3*b* and 3*b* do not interfere with each other.

Note that the configuration of the work floor 3 described above is an example, and the work floor 3 may be configured by one scaffold board 3*a*, or the scaffold board 3*a* may be connected to the beam member 5 via an attachment bracket other than a hook, and the scaffold board 3*a* may be bridged between the beam members 5 and 5 facing each other in the width direction.

As described above, since the plurality of scaffold boards 3*a* are hooked on the upper beam material 50, the load of the work floor 3 acts more on the lower beam material 51. Therefore, since the upper beam material 50 is required to have higher bending strength than the lower beam material 51, the diameter of the upper beam material 50 is larger than the diameter of the lower beam material 51 as illustrated in FIG. 3. However, as long as the strength of the beam member 5 is not insufficient, the diameter of the lower beam material 51 may be the same as the diameter of the upper beam material 50, or the diameter of the lower beam material 51 may be larger than the diameter of the upper beam material 50.

Figure 4:
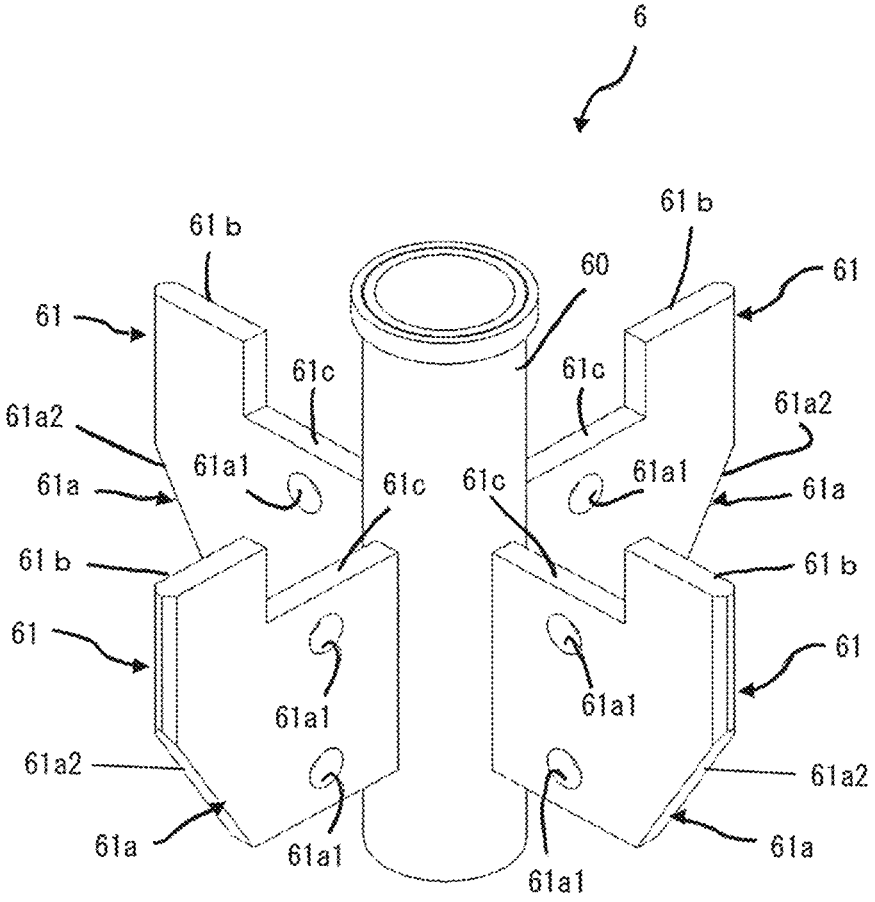
FIG. 4 is a perspective view of a joint in the hanging scaffold of the first embodiment.

As illustrated in FIG. 4, the joint 6 includes a cylindrical body 60 having an axis extending along the vertical direction, and four plates 61 disposed at intervals of 90 degrees in the circumferential direction on an outer periphery of the cylindrical body 60 and extending along the axial direction of the cylindrical body 60. The shape of the cylindrical body 60 is not limited to a cylindrical shape as long as it is a tubular shape.

The plate 61 includes a plate main body 61*a* that protrudes from the outer periphery of the cylindrical body 60 in the radial direction of the cylindrical body 60 and is oriented vertically along the axial direction of the cylindrical body 60, a protruding portion 61*b* that protrudes upward from an upper portion of the plate main body 61*a* on the distal end side, and a recessed portion 61*c* formed between the protruding portion 61*b* and the cylindrical body 60. In the present embodiment, the recessed portion 61*c* is formed between the protruding portion 61*b* at an upper end of the plate 61 and the cylindrical body 60, but the position of the recessed portion 61*c* is not particularly limited, and for example, the recessed portion 61*c* may be formed at a position separated from the cylindrical body 60 at the upper end of the plate 61.

Figure 5:
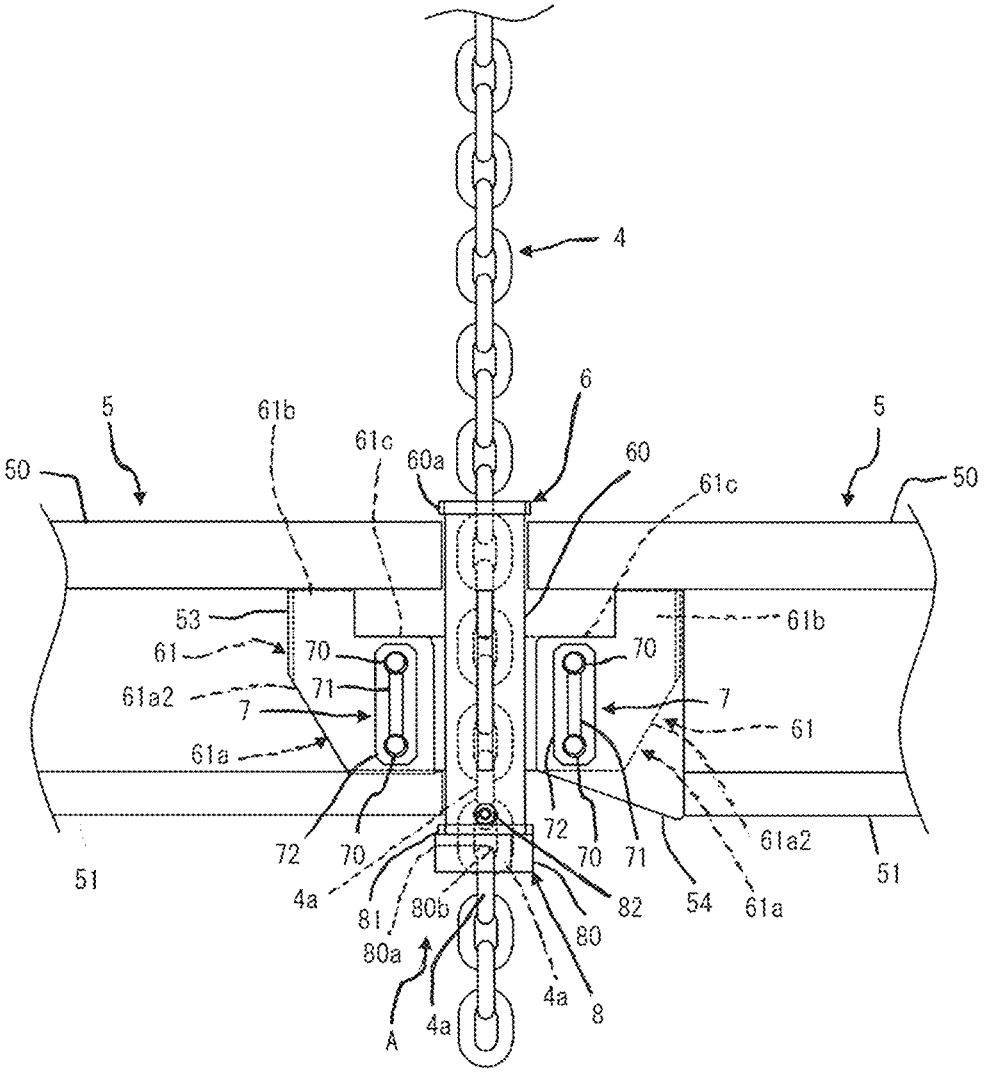
FIG. 5 is an enlarged side view illustrating a connecting portion between a joint and a beam member in the hanging scaffold of the first embodiment.

As illustrated in FIG. 5, an upper end of the protruding portion 61*b*, which is the upper end of the plate 61, is located below the upper end of the cylindrical body 60. Further, the width of the recessed portion 61*c* in the extending direction of the plate 61 (hereinafter, simply referred to as a "width of the recessed portion 61*c*") is set to be larger than the height of the upper beam material 50 in the vertical direction.

In addition, the length of the plate 61 in the vertical direction is slightly shorter than the vertical interval between the upper beam material 50 and the lower beam material 51 of the beam member 5, and the plate thickness of the plate 61 is slightly thinner than the size of the gap between the attachment pieces 53, 53, 54, and 54 of the beam member 5, so that the plate 61 can be fitted between the attachment pieces 53, 53, 54, and 54 as illustrated in FIG. 5. In addition, since the upper end and the lower end of the one-end-side attachment piece 53 are respectively connected to the upper beam material 50 and the lower beam material 51, in a state where the plate 61 is fitted between the one-end-side attachment pieces 53 and 53, the plate 61 is sandwiched between the upper beam material 50 and the lower beam material 51 unlike a case where the plate is fitted between the other-end-side attachment pieces 54 and 54, and thus, the relative movement of the beam member 5 and the joint 6 in the vertical direction is restricted.

Further, in the plate main body 61*a*, two insertion holes 61*a*1 and 61*a*1 which are arranged side by side along the vertical direction and face the pin holes 53*a* and 54*a* of the attachment pieces 53 and 54 are formed in a state where the plate 61 is fitted between the attachment pieces 53, 53, 54, and 54. As illustrated in FIG. 4, the plate main body 61*a* is provided with a relief portion 61*a*2 formed by obliquely cutting out the lower side of an opposite cylindrical body side.

Then, as illustrated in FIG. 5, in a state where the plate 61 of the joint 6 is fitted between the attachment pieces 53, 53, 54, and 54 of the beam member 5, the beam member 5 is connected to the plate 61 of the joint 6 by inserting pin portions 70 of coupling pins 7, which will be described later, as connecting members into the two pin holes 53*a*, 53*a*, 54*a*, and 54*a* and the insertion holes 61*a*1 and 61*a*1 facing each other.

In addition, in the present embodiment, since the attachment pieces 53, 53, 54, and 54 of the beam member 5 are pin-bonded to the plate 61 of the joint 6 at two locations, the rotation of the beam member 5 in the vertical direction with respect to the plate 61 is restricted as compared with the case where the attachment pieces 53, 53, 54, and 54 of the beam member 5 are pin-bonded to the plate 61 of the joint 6 at one location, so that rattling of the beam member 5 in the vertical direction is suppressed.

In the present embodiment, as illustrated in FIG. 5, the shapes of the attachment pieces 53, 53, 54, and 54 are substantially matched with the plate 61 in a state where the plate 61 is fitted between the attachment pieces 53, 53, 54, and 54. However, the shapes of the attachment pieces 53, 53, 54, and 54 are not particularly limited, and may be rectangular plate shapes, for example.

Figure 6:
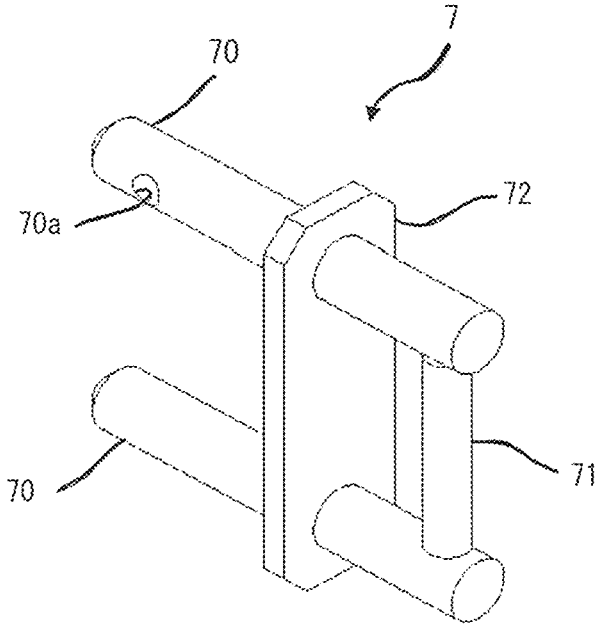
FIG. 6 is a perspective view of a coupling pin in the hanging scaffold of the first embodiment.

In addition, as illustrated in FIG. 6, the coupling pin 7 of the present embodiment includes a pair of pin portions 70 and 70 that can be inserted into the pin hole 53*a* and the insertion hole 61*a*1 and are arranged in parallel to each other at the same interval as the pair of pin holes 53*a*, 53*a*, 54*a*, and 54*a* and the pair of insertion holes 61*a*1 and 61*a*1, a columnar grip portion 71 as a connecting portion that connects the proximal end sides of the pair of pin portions 70 and 70, and a rectangular plate-shaped regulating portion 72 as a connecting portion that connects the vicinities of the centers of the pair of pin portions 70 and 70.

When the coupling pin 7 is configured as described above, the worker can insert the two pin portions 70 into the two pin holes 53*a*, 53*a*, 54*a*, and 54*a* and the insertion holes 61*a*1 and 61*a*1 (hereinafter referred to as "holes 53*a*, 54*a*, and 61*a*1") formed in the attachment pieces 53 and 54 and the plate 61 while holding the grip portion 71. As described above, since the two pin portions 70 and 70 can be inserted into the two holes 53*a*, 54*a*, and 61*al* of the attachment pieces 53 and 54 and the plate 61 at one time, the efficiency of the work of connecting the beam member 5 to the joint 6 is improved as compared with the case of inserting one pin into each of the two holes 53*a*, 54*a*, and 61*a*1.

In the present embodiment, the regulating portion 72 is provided at a position in contact with the attachment pieces 53 and 54 when the pin portion 70 in the axial direction of the pin portion 70 is inserted to an appropriate position with respect to the attachment pieces 53 and 54 and the holes 53*a*, 54*a*, and 61*a*1 of the plate 61. Therefore, if the worker inserts the pin portion 70 into the holes 53*a*, 54*a*, and 61*a*1 until the regulating portion 72 abuts on the attachment pieces 53 and 54, the insertion amount of the pin portion 70 is always constant, so that it is possible to prevent variations in connection strength between the attachment pieces 53 and 54 of the beam member 5 and the plate 61 of the joint 6.

The regulating portion 72 may be, for example, a protrusion protruding from an outer periphery of the pin portion 70. Even in this case, the insertion amount of the pin portion 70 can be made constant. However, when the regulating portion 72 is bridged between the pin portions 70 and 70 as in the present embodiment, since the pair of pin portions 70 and 70 can be supported by the grip portion 71 and the regulating portion 72, the strength against the force acting in the radial direction of the pin portion 70 increases.

In the present embodiment, a through hole 70*a* penetrating in the radial direction is formed in a distal end portion of the pin portion 70 on one side (upper side in FIG. 6). The through hole 70*a* is disposed at a position protruding from the attachment pieces 53 and 54 in a state where the pin portion 70 is inserted into the attachment pieces 53 and 54 and the holes 53*a*, 54*a*, and 61*al* of the plate 61. Although not illustrated, by inserting a retaining pin (not illustrated) into the through hole 70*a* in a state where the pin portion 70 is inserted into the holes 53*a*, 54*a*, and 61*a*1, it is possible to prevent the coupling pin 7 from coming off from the attachment pieces 53 and 54 and the holes 53*a*, 54*a*, and 61*a*1 of the plate 61.

Note that the above-described configuration of the coupling pin 7 is an example, and for example, the coupling pin 7 may be configured by omitting either the grip portion 71 or the regulating portion 72. Alternatively, the coupling pin 7 may be formed as a plurality of independent pins, and the beam member 5 may be pin-bonded to the plate 61 of the joint 6 by inserting one pin into each of the attachment pieces 53 and 54 and the holes 53*a*, 54*a*, and 61*a*1 of the plate 61.

In addition, the number of the attachment pieces 53 and 54 and the holes 53*a*, 54*a*, and 61*al* of the plate 61 and the number of the pin portions 70 of the coupling pin may be three or more. Even in this case, since the attachment pieces 53 and 54 and the plate 61 are coupled at a plurality of positions, rattling of the beam member 5 in the vertical direction can be reduced, and since the plurality of pin portions 70 and 70 can be inserted into the attachment pieces 53 and 54 and the plurality of holes 53*a*, 54*a*, and 61*a*1 of the plate 61 at one time, workability is improved.

However, the number of the attachment pieces 53 and 54 and the holes 53*a*, 54*a*, and 61*al* of the plate 61 may be one. In this case, the coupling pin may be one independent pin.

In the present embodiment, the attachment pieces 53 and 54 and the holes 53*a*, 54*a*, and 61*al* of the plate 61 are arranged side by side along the vertical direction, but the direction in which the holes 53*a*, 54*a*, and 61*a*1 are arranged is not particularly limited, and may be arranged side by side along the lateral direction, for example. However, when the holes 53*a*, 54*a*, and 61*al* are arranged side by side along the vertical direction with respect to the attachment pieces 53 and 54 and the plate 61, the lateral width (width in the left-right direction in FIG. 2) of the attachment pieces 53 and 54 and the plate 61 can be shortened as compared with the case where the holes 53*a*, 54*a*, and 61*al* are arranged side by side along the lateral direction.

As described above, the beam member 5 can be coupled to each plate 61 of the joint 6 via the coupling pin 7. The frame body 2 is configured in a quadrangular shape in plan view by connecting each end portion of the beam member 5 to the mutually opposing plates 61 of the four joints 6 via coupling pins 7, respectively. In addition, when the hanging scaffold 1 includes a plurality of frame bodies 2 as illustrated in FIG. 1, the frame bodies 2 and 2 adjacent to each other in the depth direction or the width direction share one beam member 5 disposed at the center of the frame bodies 2 and 2 and the joint 6 connected to both end portions of the beam member 5 via coupling pins 7.

Next, the chain coupling device A that couples the chain 4 to the scaffolding member 10 will be described in detail. The chain 4 is formed by connecting a plurality of annular-shaped chain elements 4*a* in a row. Hereinafter, the inside of the chain element 4*a* is referred to as a hole of the chain element 4*a*, the side facing the hole of the chain element 4*a* is referred to as a front side, the direction of the chain element 4*a* viewed from the front side is referred to as a lateral direction, the direction of the chain element 4*a* viewed from the side is referred to as a vertical direction, the width of the chain element 4*a* in the lateral direction is referred to as a lateral width, and the width of the chain element 4*a* in the vertical direction is referred to as a vertical width.

Figure 7:
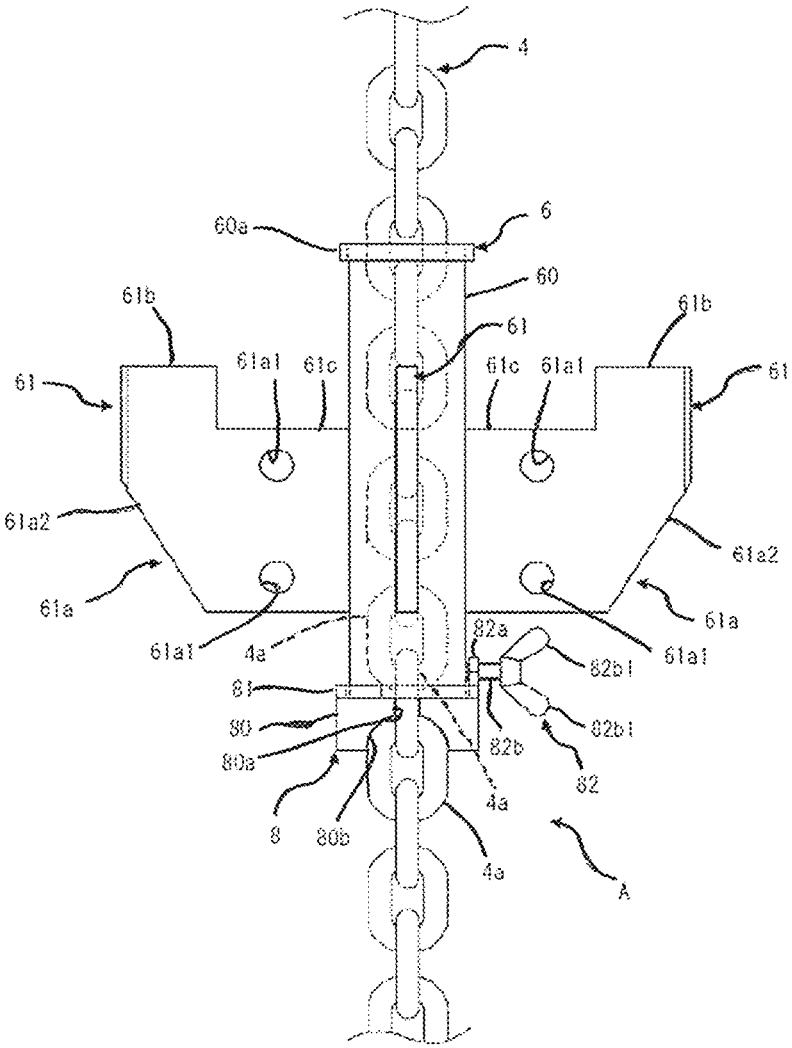
FIG. 7 is an enlarged side view illustrating a chain coupling device in the hanging scaffold of the first embodiment.

As illustrated in FIG. 7, the chain coupling device A includes the cylindrical body 60 of the joint 6 into which the chain 4 is inserted, and a stopper 8 having a notch 80*a* with a width narrower than the lateral width of the chain element 4*a* and wider than the vertical width of the chain element 4*a* and abutting on the lower end of the cylindrical body 60. In FIG. 7, an illustration of the beam member 5 is omitted for easy understanding of the configuration of the chain coupling device A.

Figure 8:
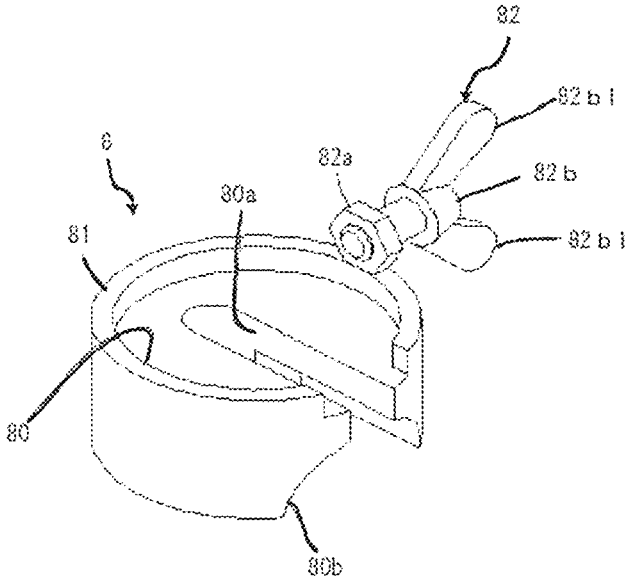
FIG. 8 is an enlarged perspective view illustrating a stopper of the chain coupling device in the hanging scaffold of the first embodiment.

More specifically, the stopper 8 of the present embodiment includes a regulating portion 80 that abuts on the lower end of the cylindrical body 60, and as illustrated in FIGS. 7 and 8, the regulating portion 80 has a disk shape and includes the notch 80*a* that opens from the upper end side and a semicircular recessed portion 80*b* that opens from the lower end side and communicates with the notch 80*a* and can accommodate an upper portion of the chain element 4*a*. The notch 80*a* is formed by cutting out an upper end of the regulating portion 80 in a rounded rectangular shape with a length equal to or longer than the radius of the regulating portion 80 in the radial direction from the side. The width of the notch 80*a* in the lateral direction (hereinafter, simply referred to as a "width of the notch 80*a*") when the stopper 8 is viewed from the side is set to be narrower than the lateral width of the chain element 4*a* and wider than the vertical width of the chain element 4*a*.

In addition, as illustrated in FIG. 7, the recessed portion 80*b* of the present embodiment is formed by cutting out the lower end of the disk-shaped regulating portion 80 in a semi-cylindrical shape slightly beyond the center of the regulating portion 80 in the radial direction from the side so that the center and the axis passing through the center of the notch 80*a* along the vertical direction in the left-right direction in FIG. 7 are on the same straight line when the regulating portion 80 is viewed from the side, and an upper portion of the recessed portion 80*b* communicates with the notch 80*a*. In the present embodiment, the recessed portion 80*b* is formed by cutting a lower end of the regulating portion 80 slightly beyond the center of the regulating portion 80 in the radial direction from the side direction, but may be formed by penetrating the regulating portion 80 in the radial direction. In addition, the recessed portion 80*b* is formed in a size corresponding to the upper portion of the chain element 4*a* of the chain 4.

In the stopper 8 configured as described above, since the width of the notch 80*a* is wider than the width of the vertical chain element 4*a*, the vertical chain element 4*a* can be inserted into the notch 80*a* when the stopper 8 slidingly moves in the lateral direction toward the chain 4 side in a state where the notch 80*a* and the vertical chain element 4*a* face each other in the horizontal direction. In addition, since the width of the notch 80*a* is narrower than the width of the lateral chain element 4*a*, the notch 80*a* does not allow the two lateral chain elements 4*a* and 4*a* connected above and below the vertical chain element 4*a* inserted into the notch 80*a* to pass in the vertical direction in a state where the vertical chain element 4*a* is inserted inside. That is, the notch 80*a* allows the chain 4 to be inserted from the lateral direction, but does not allow the chain 4 inserted inside to move in the vertical direction. Therefore, when the vertical chain element 4*a* is inserted into the notch 80*a* of the regulating portion 80, the stopper 8 is connected to the chain 4 in a state where the vertical movement is regulated.

Therefore, when the stopper 8 is suspended by the chain 4 in a state where the vertical chain element 4*a* located below the lower end of the cylindrical body 60 of the chain 4 is inserted into the notch 80*a* of the regulating portion 80, an upper surface of the regulating portion 80 abuts on the lower end of the cylindrical body 60, and the cylindrical body 60 is supported from below by the stopper 8, so that the scaffolding member 10 is suspended and supported by the chain 4 together with the stopper 8.

As described above, in the chain coupling device A according to the present embodiment, when the stopper 8 slidingly moves in the lateral direction toward the chain 4, the vertical chain element 4*a* located below the lower end of the cylindrical body 60 is inserted into the notch 80*a* of the regulating portion 80, and the chain 4 is pulled upward, the chain 4 can be attached to the cylindrical body 60. Therefore, in the chain coupling device A according to the present embodiment, it is not necessary to adjust the orientation of the chain element 4*a* and the position of the hole so as to have the same height and the same direction as the position of the through hole of the cylindrical body, and thus the chain 4 can be easily connected to the scaffolding member 10, as compared with the conventional case where the chain is connected to the cylindrical body by adjusting the position and orientation of the hole of the chain element of the chain inserted into the cylindrical body so as to face the through hole provided in the cylindrical body and then inserting the pin into the hole of the chain element and the through hole.

In addition, in the conventional hanging scaffold, the load of a scaffolding member and the load of a load loaded on the scaffolding member act on a pin connecting the chain and the cylindrical body. At this time, since the load concentrates on the portion of the pin inserted into the through hole provided in the cylindrical body, it is necessary to increase the strength of the pin as the load increases. However, the diameter of the pin is limited to the size of the pin passing through the hole of the chain element, and when the diameter of the pin is increased, the diameter of the cylindrical body needs to be increased, and there is a limit to increase the strength of the pin. Therefore, in the conventional hanging scaffold, it is difficult to increase the maximum loading load.

On the other hand, in the chain coupling device A of the present embodiment, since the stopper 8 supports the cylindrical body 60 by bringing the upper surface of the regulating portion 80 into contact with the lower end of the cylindrical body 60, the regulating portion 80 can ensure sufficient strength without being limited by the size of the hole of the chain element 4*a*, and thus can ensure necessary strength according to the loading load required for the hanging scaffold 1. Therefore, according to the hanging scaffold 1 including the chain coupling device A, the maximum loading load of the hanging scaffold 1 can be increased, and the number of chains 4 can also be reduced.

In the present embodiment, the notch 80*a* is formed in a rounded rectangular shape and has a constant lateral width. As described above, the lateral width of the notch 80*a* is wider than the vertical width of the chain element 4*a* and narrower than the lateral width of the chain element 4*a*. Therefore, in the present embodiment, the entire width of the notch 80*a* is wider than the vertical width of the chain element 4*a* and narrower than the lateral width of the chain element 4*a*, but the width of the other portion of the notch 80*a* may be wider than the vertical width of the chain element 4*a* as long as at least the width of a part of the notch 80*a* is wider than the vertical width of the chain element 4*a* and narrower than the lateral width of the chain element 4*a*. However, as in the present embodiment, when the entire width of the notch 80*a* is wider than the vertical width of the chain element 4*a* and narrower than the lateral width of the chain element 4*a*, the stopper 8 does not fall off from the chain 4 even if the chain 4 is slightly displaced in the lateral direction with respect to the stopper 8.

In addition, normally, when the stopper 8 slidingly moves in the lateral direction and the vertical chain element 4*a* is inserted into the notch 80*a* of the regulating portion 80 in this manner, the wall thickness of the regulating portion 80 has to be made smaller than the size of the gap between the lateral chain elements 4*a* and 4*a* adjacent to each other vertically so that the regulating portion 80 does not interfere with the lateral chain element 4*a*. However, since the regulating portion 80 of the present embodiment includes the semicircular recessed portion 80*b* that opens from the lower end side of the regulating portion 80, communicates with the notch 80*a*, and can accommodate the upper portion of the chain element 4*a*, even if the thickness of the entire regulating portion 80 is set to be equal to or larger than the size of the gap between the lateral chain elements 4*a* and 4*a* adjacent to each other in the vertical direction, the thickness of the portion of the regulating portion 80 around the notch 80*a* can be reduced. Therefore, it is possible to secure the thickness of the other portion of the regulating portion 80 while allowing the portion around the notch 80*a* in the regulating portion 80 to be inserted between the lateral chain elements 4*a* and 4*a*, and thus, the stopper 8 can obtain sufficient strength.

The recessed portion 80*b* of the present embodiment is formed in a semicircular shape having a size corresponding to the upper portion of the chain element 4*a* of the chain 4. Therefore, as illustrated in FIG. 7, in a state where the vertical chain element 4*a* is inserted into the notch 80*a*, an upper end of the lateral chain element 4*a* connected to the lower end of the vertical chain element 4*a* inserted into the notch 80*a* is fitted into the recessed portion 80*b*. Therefore, sitting of the chain element 4*a* in the recessed portion 80*b* is improved, abrasion of the upper end of the chain element 4*a* can be suppressed, and the scaffolding member 10 can be stably suspended by the chain 4. However, the size of the recessed portion 80*b* may not be the same size as the upper portion of the chain element 4*a* as long as the recessed portion is large enough to accommodate the upper portion of the chain element 4*a*.

If the strength of the stopper 8 is not insufficient, the entire thickness of the regulating portion 80 may be made smaller than the size of the gap between the lateral chain elements 4*a* and 4*a* adjacent to each other in the vertical direction. In this case, the recessed portion 80*b* is omitted.

In the stopper 8 of the present embodiment, the regulating portion 80 abutting on the lower end of the cylindrical body 60 includes the notch 80*a* that regulates the vertical movement of the chain 4, but such a structure of the stopper 8 is an example. For example, the stopper 8 may have a structure separately including a regulating portion abutting on the lower end of the cylindrical body 60 and a chain attachment portion having a notch having a width narrower than the lateral width of the chain element 4*a* and wider than the vertical width of the chain element 4*a*.

However, when the regulating portion 80 abutting on the lower end of the cylindrical body 60 includes the notch 80*a* as in the present embodiment, the stopper 8 does not need to include a chain attachment portion having the notch separately from the regulating portion 80, so that the stopper 8 can be downsized and the material can be reduced.

As illustrated in FIGS. 7 and 8, the stopper 8 includes a fitting portion 81 provided at the upper end of the regulating portion 80 and fitted to an outer periphery of the lower end of the cylindrical body 60. Specifically, the fitting portion 81 has a C-shaped tubular shape having an inner diameter larger than the outer diameter of the cylindrical body 60 and fitted to the outer periphery of the lower end of the cylindrical body 60, and protrudes upward from an outer peripheral edge of the regulating portion 80 with the opening matching the opening of the notch 80*a* of the regulating portion 80 in order to allow the chain element 4*a* to be inserted into the notch 80*a*.

In the stopper 8 configured as described above, after the vertical chain element 4*a* of the chain 4 located below the lower end of the cylindrical body 60 is inserted into the notch 80*a* of the regulating portion 80, the upper end of the regulating portion 80 and the lower end of the cylindrical body 60 are brought close to each other, and when the lower end of the cylindrical body 60 abuts on the upper surface of the regulating portion 80 as illustrated in FIG. 7, the lower end of the cylindrical body 60 enters the inside of the fitting portion 81 and is fitted. As described above, when the outer periphery of the lower end of the cylindrical body 60 is fitted into the fitting portion 81, the movement of the stopper 8 in the lateral direction with respect to the cylindrical body 60 is restricted, so that the stopper 8 can be prevented from falling off the chain 4.

In the present embodiment, the C-shaped tubular fitting portion 81 having an inner diameter larger than the outer diameter of the cylindrical body 60 is provided along the peripheral edge of the regulating portion 80, and the lower end of the cylindrical body 60 enters and is fitted to the inside of the fitting portion 81. However, the C-shaped tubular fitting portion 81 having an outer diameter smaller than the inner diameter of the cylindrical body 60 and fitted to the inner periphery of the cylindrical body 60 may be provided inside the peripheral edge of the regulating portion 80, and the fitting portion 81 may be fitted to the inside of the cylindrical body 60. Alternatively, a circular-annular-shaped groove that allows the fitting of the lower end of the cylindrical body 60 may be provided at the upper end of the regulating portion 80 to be fitted thereto.

The shape of the fitting portion 81 is not particularly limited as long as the lateral movement of the stopper 8 with respect to the cylindrical body 60 can be regulated in the state of being fitted to the lower end of the cylindrical body 60. For example, the fitting portion 81 may be formed of a plurality of circular-arc-shaped protrusions intermittently protruding along the circumferential direction from the outer peripheral edge of the upper end of the regulating portion 80. When the cross-sectional shape of the cylindrical body 60 is other than a circle, the shape of the fitting portion 81 may be appropriately changed in accordance with the cross-sectional shape of the cylindrical body 60. However, the fitting portion 81 may be omitted.

In addition, a pressing means 82 that is movable toward and away from the outer periphery of the cylindrical body 60 and presses the outer periphery of the cylindrical body 60 is provided at an upper end of the fitting portion 81. Specifically, the pressing means 82 includes a nut 82*a* in which a screw hole (not denoted) is attached to the upper end of the fitting portion 81 in a direction facing the outer periphery of the cylindrical body 60, and a bolt 82*b* screwed into the nut 82*a*, and when the bolt 82*b* is rotated in the circumferential direction, the bolt 82*b* moves toward and away from the cylindrical body 60 in the manner of a feed screw.

Then, as illustrated in FIG. 7, when the bolt 82*b* is rotated with respect to the nut 82*a* to approach the cylindrical body 60 in a state where the fitting portion 81 is fitted to the lower end of the cylindrical body 60 and the upper surface of the regulating portion 80 abuts on the lower end of the cylindrical body 60, the distal end of the bolt 82*b* abuts on the outer periphery of the cylindrical body 60 to press the cylindrical body 60 from the lateral direction. As described above, when the outer periphery of the cylindrical body 60 is pressed by the bolt 82*b*, even if the inner diameter of the fitting portion 81 is slightly larger than the design due to a dimensional error or the like and a gap is formed between the inner periphery of the fitting portion 81 and the outer periphery of the cylindrical body 60, the outer periphery of the cylindrical body 60 is pressed against the inner periphery of the fitting portion 81, so that the stopper 8 cannot move in the lateral direction. Therefore, it is possible to prevent the stopper 8 from rattling in the lateral direction without strictly controlling the dimensions of the fitting portion 81. In the present embodiment, since the bolt 82*b* is a butterfly bolt provided with a pair of circular-arc-shaped handles 82*b*1 and 82*b*1 at the base end, it is easy to rotate the bolt 82*b* without using a tool. However, the bolt 82*b* may be other than the butterfly bolt, and may be rotated using a tool.

Note that the configuration of the pressing means 82 described above is an example, and the configuration of the pressing means 82 is not particularly limited as long as the pressing means can press the cylindrical body 60 against the fitting portion 81 by pressing the cylindrical body 60 by moving toward and away from the outer periphery of the cylindrical body 60. For example, the pressing means may have a configuration of including a pressing pin having a flange provided on the outer periphery, a spring seat plate provided at the upper end of the fitting portion and having a hole through which the pressing pin is slidably inserted, and a coil spring interposed between the spring seat plate and the flange to bias the pressing pin toward the cylindrical body 60 side. In the pressing means configured as described above, the pressing pin can be moved toward the cylindrical body 60 by the biasing force of the coil spring to press the cylindrical body 60, and the pressing pin can be moved away from the cylindrical body 60 by pulling the pressing pin against the biasing force of the coil spring. However, in a case where slight rattling of the stopper 8 in the lateral direction is allowed, the pressing means 82 may be omitted.

Note that the number of chains 4 of the hanging scaffold 1 of the present embodiment can be set to any number in accordance with the size and the supporting load of the scaffolding members 10, and the chains 4 may not be connected to the cylindrical bodies 60 of all the joints 6. In addition, in the present embodiment, the chain coupling device A is provided on the joint 6 to couple the chain 4 to the joint 6. However, the chain coupling device A may be provided on a portion other than the joint 6 of the scaffolding member 10, for example, the cylindrical body 60 may be provided on the beam member 5, and the chain 4 may be coupled to the cylindrical body 60 via the stopper 8.

Next, a method for assembling the hanging scaffold 1 of the present embodiment will be described in detail. First, the beam member 5 and the joint 6 are connected by the coupling pin 7 as described above to assemble a plurality of frame bodies 2, the work floor 3 is installed on each frame body 2, and the scaffolding member 10 is assembled on the ground. Then, the chain 4 is connected to the scaffolding members 10 assembled on the ground (hereinafter, referred to as "existing scaffolding members 10") by the chain coupling device A. Specifically, as described above, the chain 4 is inserted into the cylindrical body 60 of each joint 6 of the scaffolding member 10, the stopper 8 is slidingly moved in the lateral direction with respect to the chain element 4*a* of the chain 4 located below the lower end of the cylindrical body 60, the chain element 4*a* is inserted into the notch 80*a* of the stopper 8, and the chain 4 is pulled upward to bring the upper surface of the regulating portion 80 of the stopper 8 into contact with the lower end of the cylindrical body 60, thereby connecting the chain 4 to the cylindrical body 60 of the joint 6. As described above, the chain 4 can be easily connected to the cylindrical body 60 simply by inserting the chain element 4*a* located below the lower end of the cylindrical body 60 into the notch 80*a* of the regulating portion 80, and thus, the working time can be shortened. Then, by lifting the chain 4 with a heavy machine or a chain block and fixing the chain 4 to a building or a construction, the existing scaffolding member 10 is suspended from the building, the construction, or the like as illustrated in FIG. 1.

Figure 9:
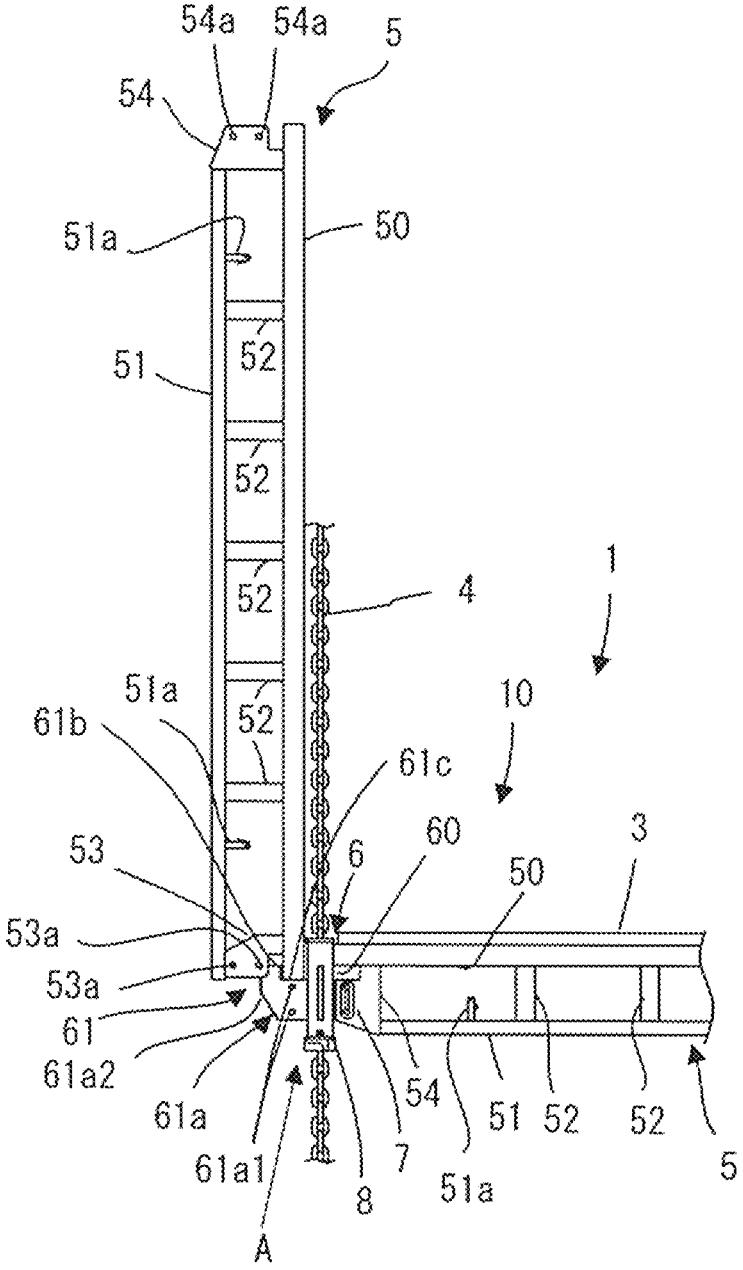
FIG. 9 is a view for explaining the method for assembling the hanging scaffold of the first embodiment, and is a view illustrating a step of inserting one end of an upper beam material of the beam member into a recessed portion of a plate of the joint in a posture along the vertical direction.

Next, a method of expanding the floor area of the scaffolding member 10 suspended from a building, a construction, or the like will be described. Hereinafter, the components to be attached to the existing scaffolding member 10 will be described with "for expansion" added to the end of the word. First, as illustrated in FIG. 9, the scaffolding member 10 is inserted into the recessed portion 61*c* formed at the upper end of the plate 61 of the joint 6 disposed on the back side which is the side where the floor area is expanded in the depth direction in the existing scaffolding member in a posture along the vertical direction standing with one end of the upper beam material 50 of the beam member 5 for expansion facing downward. Thereafter, as indicated by a solid line in FIG. 10, while supporting the beam member 5 for expansion via a support tool such as a rope (not illustrated) attached to the other end which is the distal end of the beam member 5 for expansion, the worker gradually bends the beam member 5 for expansion while rotating the other end of the upper beam material 50 to the back side with one end of the upper beam material 50 as a fulcrum. Note that the support tool by which the worker supports the beam member 5 for expansion may be other than a rope, and may be, for example, a belt, a chain, or a small crane.

Here, since the width of the recessed portion 61*c* is wider than the height of the upper beam material 50 in the vertical direction, as illustrated in FIG. 9, one end of the upper beam material 50 can be inserted into the recessed portion 61*c* in a posture along the vertical direction, and a gap is formed between one end of the upper beam material 50 and a side wall (the protruding portion 61*b* and the cylindrical body 60) of the recessed portion 61*c*. Then, since the upper beam material 50 can be brought into the posture along the vertical direction, the posture of the upper beam material 50 is stabilized in the recessed portion 61*c*, and since a gap is formed between one end of the upper beam material 50 and the side wall of the recessed portion 61*c* (the protruding portion 61*b* and the cylindrical body 60), the rotation of the upper beam material 50 to the back side is allowed, so that the work of tilting the beam member 5 for expansion in the posture along the vertical direction to the back side can be safely and easily performed.

The "posture along the vertical direction" of the upper beam material 50 described above when one end of the upper beam material 50 is inserted into the recessed portion 61*c* includes not only a posture along the vertical direction but also a posture inclined toward the back side. Therefore, the corner of one end of the upper beam material 50 may be inserted into the recessed portion 61*c* while the upper beam material 50 is inclined toward the back side from the beginning. As described above, when the corner of one end of the upper beam material 50 inclined toward the back side from the beginning is inserted into the recessed portion 61*c*, the width of the recessed portion 61*c* may be narrower than the height of the upper beam material 50 in the vertical direction as long as the corner of one end of the upper beam material 50 can be inserted.

Figure 10:
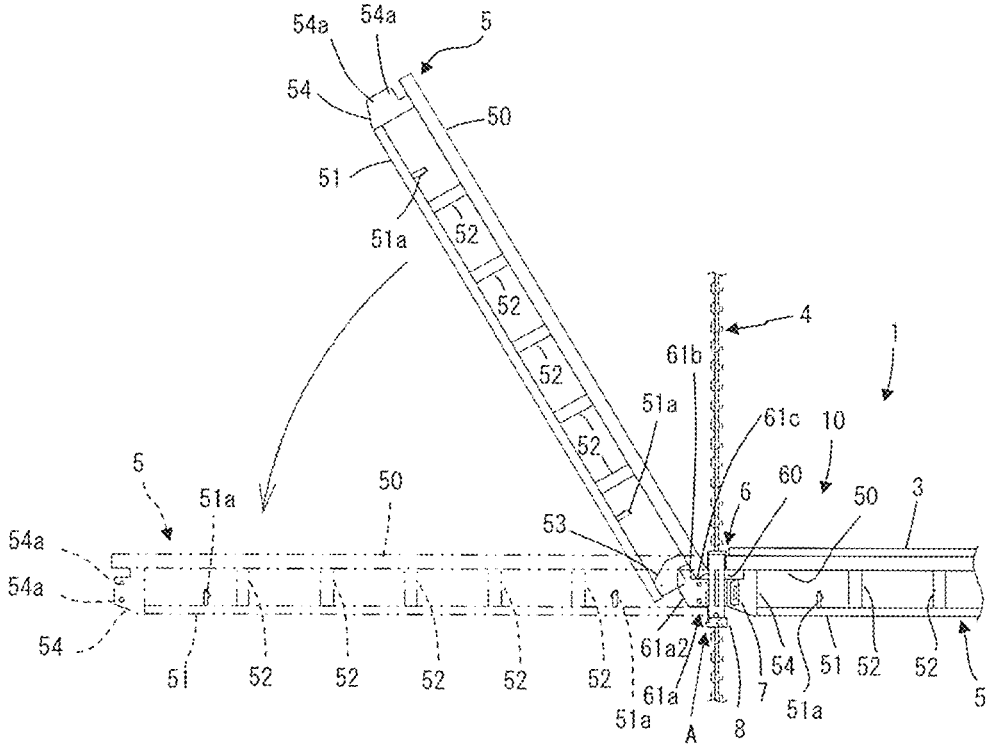
FIG. 10 is a view for explaining the method for assembling the hanging scaffold of the first embodiment, and is a view illustrating a step of rotating and laying down the other end of the upper beam material of the beam member toward the back side.

In addition, as indicated by a solid line in FIG. 10, in a state where the beam member 5 for expansion is inclined toward the back side, one end of the upper beam material 50 abuts on a corner portion of an upper end of the protruding portion 61*b* which is a side wall on the back side of the recessed portion 61*c*. That is, the beam member 5 for expansion falls down to the back side while the upper beam material 50 is supported by the upper end of the plate 61. Therefore, when the beam member 5 for expansion is tilted toward the back side, it is possible to prevent the beam member 5 for expansion from falling at once, so that the beam member 5 for expansion can be safely tilted toward the back side. Furthermore, since one end of the upper beam material 50 inserted into the recessed portion 61*c* is sandwiched in the depth direction by the side walls (the protruding portion 61*b* and the cylindrical body 60) of the recessed portion 61*c*, it is possible to prevent one end of the upper beam material 50 from sliding on the upper surface of the plate 61 and moving when the beam member 5 for expansion is tilted toward the back side.

Then, when the upper beam material 50 of the beam member 5 for expansion falls down until the axial direction takes a posture along the horizontal direction (lateral posture) as indicated by a broken line in FIG. 10, the lower end of the upper beam material 50 is supported by the upper end of the protruding portion 61*b*, the plate 61 is fitted between the one-end-side attachment pieces 53 and 53, and the pin hole 53*a* of the one-end-side attachment piece 53 and the insertion hole 61*a*1 of the plate 61 face each other.

Here, the upper end of the protruding portion 61*b*, which is the upper end of the plate 61, is located below the upper end of the cylindrical body 60. Therefore, when the upper beam material 50 of the beam member 5 for expansion takes a lateral posture, as indicated by a broken line in FIG. 10, since the end surface on one end side (right side in the drawing) of the upper beam material 50 faces the outer periphery of the cylindrical body 60, when the end surface of the upper beam material 50 is brought into contact with the outer periphery of the cylindrical body 60, the beam member 5 for expansion can be positioned in the extending direction (left-right direction in the drawing) of the plate 61. Note that the difference in height between the upper end of the protruding portion 61*b* and the upper end of the cylindrical body 60 may be equal to or less than the height of the upper beam material 50 in the vertical direction as long as the end surface of the upper beam material 50 is hooked by the cylindrical body 60. However, if it is unnecessary to position the beam member 5 for expansion in the extending direction of the plate 61, the upper end of the protruding portion 61*b* may be positioned above the upper end of the cylindrical body 60.

As described above, the pair of one-end-side attachment pieces 53 and 53 are vertically bridged between the upper beam material 50 and the lower beam material 51, and the lower side of the gap between the one-end-side attachment pieces 53 and 53 is closed by the lower beam material 51. Therefore, when the upper beam material 50 of the beam member 5 for expansion is in the lateral posture, the lower beam material 51 abuts on the lower end of the plate 61, and the upper beam material 50 of the beam member 5 for expansion can be prevented from further falling down, so that the beam member 5 for expansion can be positioned at a position where the pin hole 53*a* of the one-end-side attachment piece 53 and the insertion hole 61*a*1 of the plate 61 face each other.

In addition, when the pair of one-end-side attachment pieces 53 and 53 are bridged between the upper beam material 50 and the lower beam material 51 in this manner, when the beam member 5 for expansion is tilted to the back side and the plate 61 is fitted between the one-end-side attachment pieces 53 and 53, the rotation track drawn by one end of the lower beam material 51 passes through the plate 61 side.

On the other hand, the plate 61 of the present embodiment is provided with a relief portion 61*a*2 formed by cutting out the lower side of the plate main body 61*a* on the opposite cylindrical body side so that the plate 61 is not disposed on the rotation track drawn by one end of the lower beam material 51 when the plate 61 is fitted between the one-end-side attachment pieces 53 and 53 by tilting the beam member 5 for expansion to the back side. Therefore, even if the pair of one-end-side attachment pieces 53 and 53 are bridged between the upper beam material 50 and the lower beam material 51 in this manner, when the beam member 5 for expansion is tilted to the back side and the plate 61 is fitted between the one-end-side attachment pieces 53 and 53, it is possible to avoid the lower beam material 51 of the beam member 5 for expansion from interfering with the plate 61.

In the present embodiment, the relief portion 61*a*2 is formed by obliquely cutting out the plate main body 61*a*, but the cutout shape is not particularly limited, and may be formed by cutting out the plate main body 61*a* in a circular arc shape or an L shape, for example. However, when the relief portion 61*a*2 is formed by obliquely cutting out the plate main body 61*a*, processing is easy as compared with a case of being formed by cutting out the plate main body 61*a* in a circular arc shape, and an area where the plate main body 61*a* is cut out is reduced as compared with a case of being formed by cutting out the plate main body 61*a* in an L shape, so that a decrease in strength of the plate 61 can be suppressed.

In addition, the means for avoiding the interference of the lower beam material 51 with the plate 61 when the beam member 5 for expansion is tilted toward the back side and the plate 61 is fitted between the one-end-side attachment pieces 53 and 53 is not limited to the method of providing the relief portion 61*a*2 of the plate main body 61*a* on the opposite cylindrical body side. For example, the length of the plate 61 in the vertical direction may be shortened to such an extent that the lower beam materials 51 do not interfere with each other, or the vertical interval between the upper beam material 50 and the lower beam material 51 may be increased to such an extent that the lower beam materials 51 do not interfere with each other. However, when the length of the plate 61 in the vertical direction is shortened, the strength of the plate 61 is reduced, and when the interval between the upper beam material 50 and the lower beam material 51 in the vertical direction is increased, the height of the beam member 5 in the vertical direction is increased, so that the beam member 5 is increased in size and the weight is increased.

On the other hand, when the relief portion 61*a*2 is provided on the opposite cylindrical body side of the plate main body 61*a* as in the present embodiment to avoid interference of the lower beam material 51 with the plate 61, it is not necessary to change the vertical length of the plate 61 or the vertical interval between the upper beam material 50 and the lower beam material 51, so that it is possible to avoid an increase in the weight of the beam member 5 while preventing a decrease in the strength of the plate 61.

Although not illustrated, in a state where the other end of the beam member 5 for expansion is inserted into the recessed portion 61*c* of the plate 61 in a posture along the vertical direction, the beam member 5 for expansion may be tilted toward the back side, and the plate 61 may be fitted between the other-end-side attachment pieces 54 and 54. In this case, since the lower ends of the pair of other-end-side attachment pieces 54 and 54 are connected to the other end surface of the lower beam material 51, the lower beam material 51 does not interfere with the plate 61 when the beam member 5 for expansion is tilted toward the back side and the plate 61 is fitted between the other-end-side attachment pieces 54 and 54 without providing the relief portion 61*a*2 in the plate 61.

In addition, the above-described step of inserting one end of the upper beam material 50 into the recessed portion 61*c* of the plate 61 in a posture along the vertical direction and the step of tilting the other end of the upper beam material 50 by rotating the other end of the upper beam material 50 to the back side in a state where one end of the upper beam material 50 is inserted into the recessed portion 61*c* and fitting the plate 61 between the one-end-side attachment pieces 53 and 53 of the upper beam member can be performed without allowing the worker to get on the work floor 3 of the existing scaffolding member 10.

Thereafter, in a state where the upper beam material 50 of the beam member 5 for expansion is in the lateral posture, the coupling pin 7 is inserted into the pin hole 53*a* of the one-end-side attachment piece 53 and the insertion hole 61*a*1 of the plate 61 facing each other, and the beam member 5 is connected to the plate 61 of the joint 6. Here, since the plate 61 of the joint 6 is in close proximity to the work floor 3 of the existing scaffolding member 10, the worker can perform the work of inserting the coupling pin 7 into the pin hole 53*a* of the one-end-side attachment piece 53 and the insertion hole 61*a*1 of the plate 61 without bending over the work floor 3.

As described above, according to the above method, in the work of connecting the beam member 5 for expansion to the joint 6 disposed on the back side in the depth direction in the existing scaffolding member 10, the worker does not need to bend over the work floor 3 of the existing scaffolding member 10, so that the work of expanding the floor area of the scaffolding member 10 can be safely performed.

Figure 11:
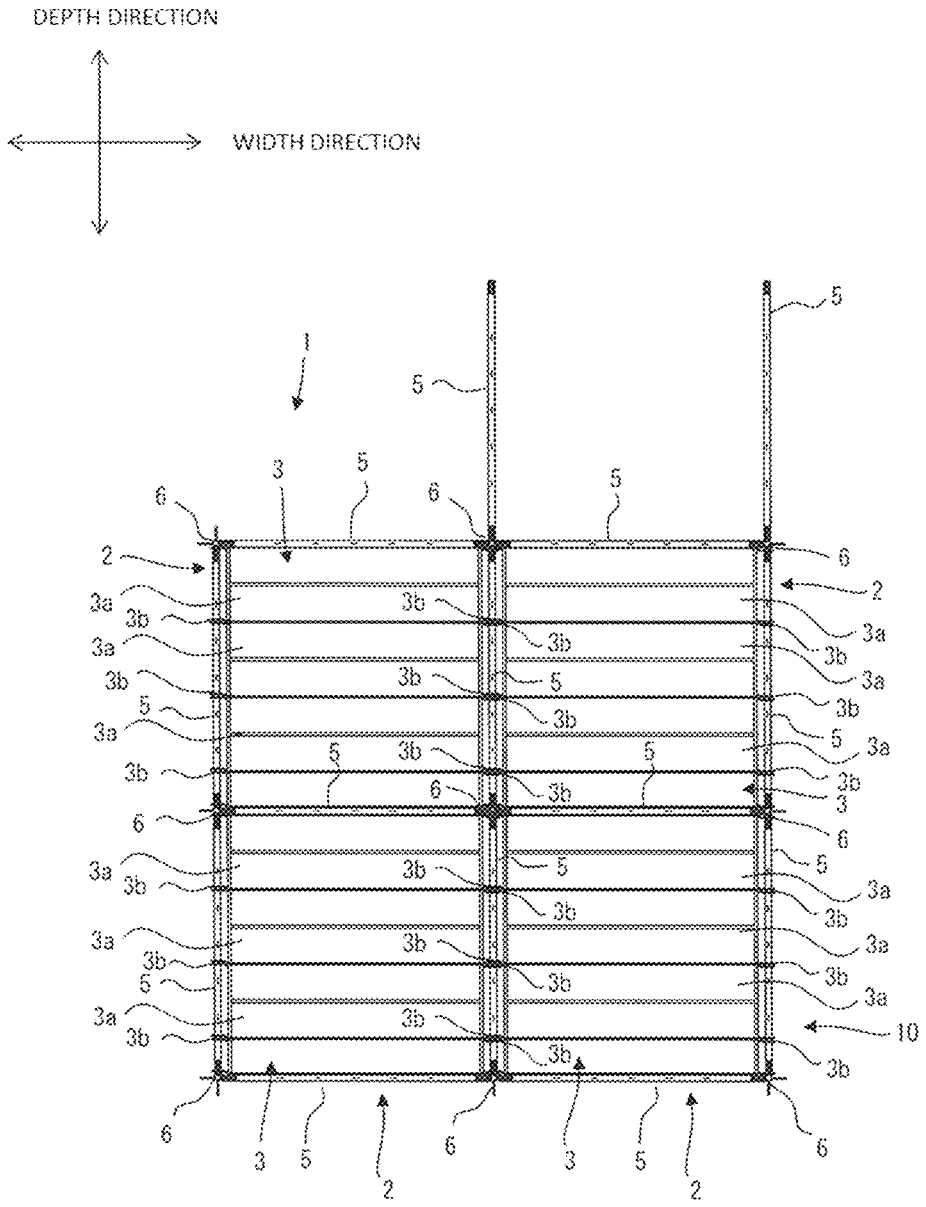
FIG. 11 is a view for explaining the method for assembling the hanging scaffold of the first embodiment, and is a view illustrating a step of arranging two beam members extending along the depth direction in parallel.

Subsequently, the beam member 5 for expansion is connected to the joint 6 adjacent in the width direction to the joint 6 to which the beam member 5 for expansion is connected in the same procedure. Then, as illustrated in FIG. 11, the two beam members 5 and 5 for expansion extending along the depth direction are arranged in parallel.

Figure 12:
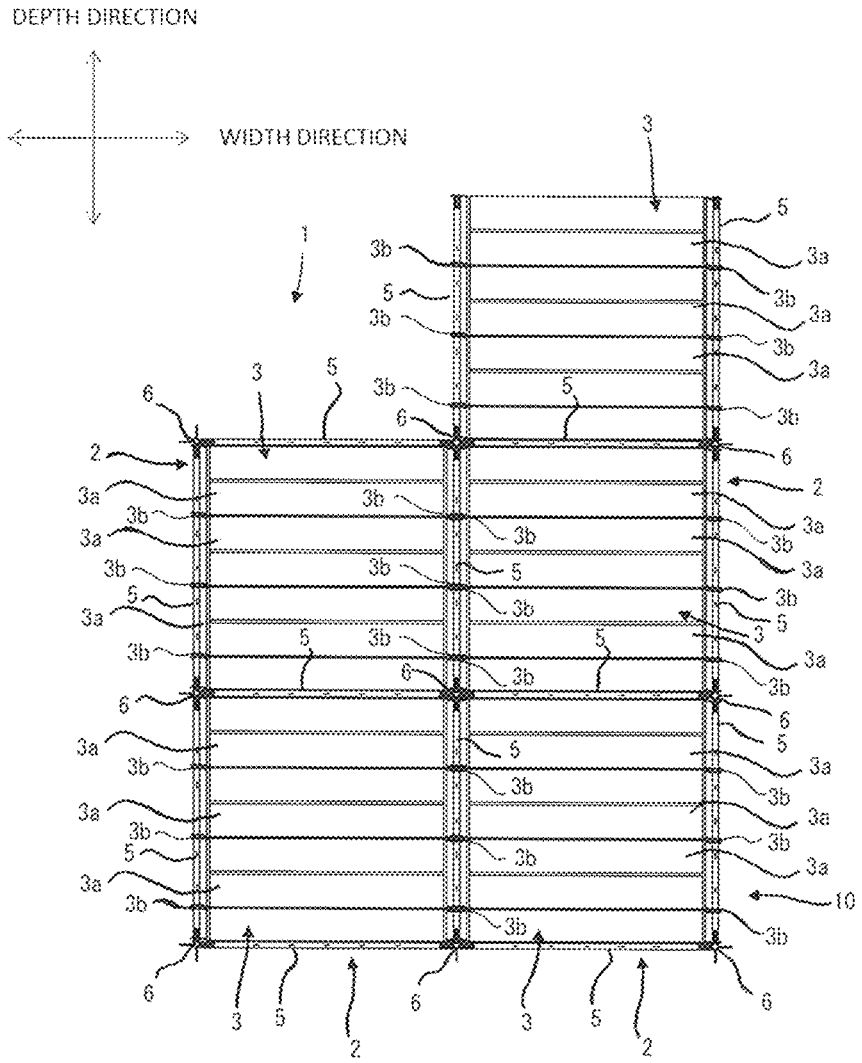
FIG. 12 is a view for explaining the method for assembling the hanging scaffold of the first embodiment, and is a view illustrating a step of installing a work floor between two beam members arranged in parallel.
Figure 13:
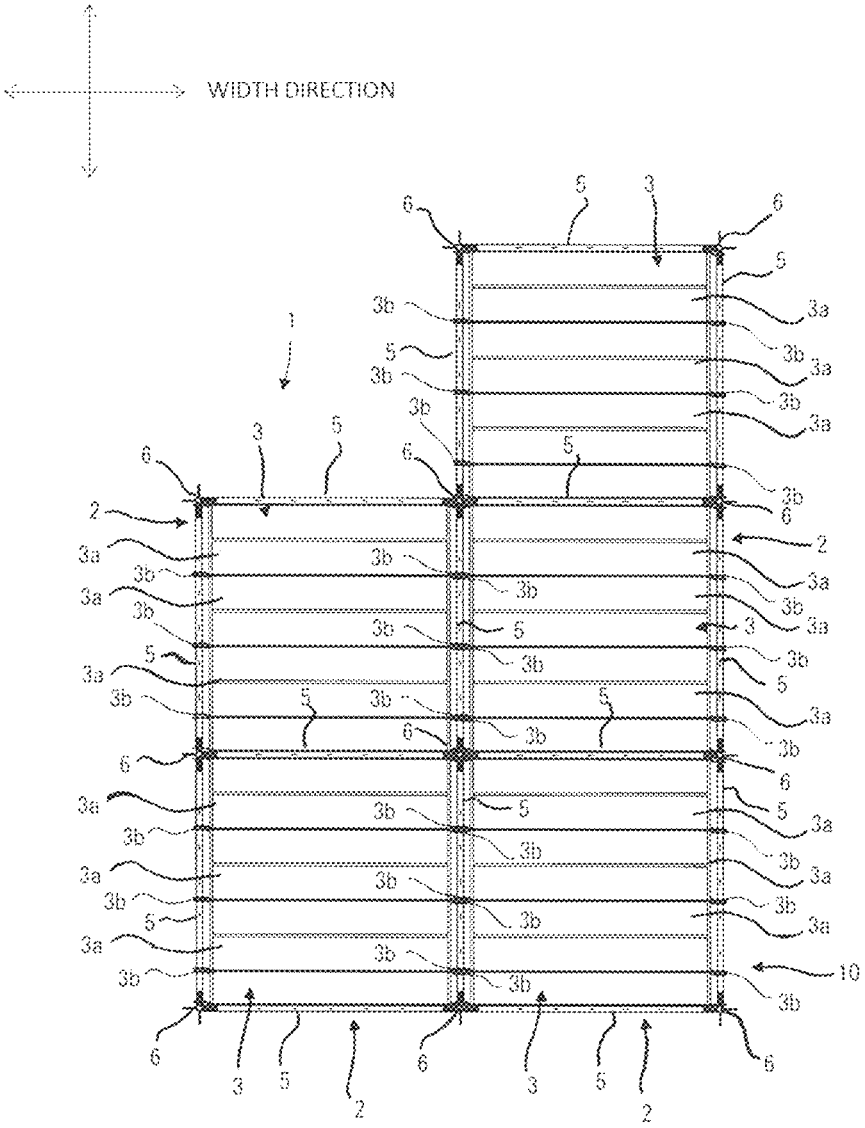
FIG. 13 is a view for explaining the method for assembling the hanging scaffold of the first embodiment, and is a view illustrating a step of bridging a beam member along the width direction between joints attached to the other ends of two beam members arranged in parallel.

Next, as illustrated in FIG. 12, a plurality of scaffold board 3*a* for expansion are bridged between two beam members 5 and 5 for expansion arranged in parallel, and the work floor 3 is installed. Thereafter, as illustrated in FIG. 13, the joint 6 for expansion is attached to each of the other-end-side attachment pieces 54 and 54 of the two beam members 5 for expansion. Specifically, after the joint 6 for expansion is connected to the chain 4 suspended from a building, a construction, or the like in advance via the stopper 8, the joint 6 for expansion is attached to the other-end-side attachment piece 54 of the beam member 5 for expansion via the coupling pin 7. Then, in order to attach the chain 4 to the joint 6 for expansion, it is not necessary for the worker to bend over the work floor 3. In addition, the work of connecting the joint 6 for expansion to the chain 4 is performed in the air. However, as described above, the chain 4 can be connected to the cylindrical body 60 of the joint 6 by simply inserting the chain 4 into the cylindrical body 60 of the joint 6 for expansion, slidingly moving the stopper 8 in the lateral direction with respect to the chain element 4*a* of the chain 4 located below the lower end of the cylindrical body 60, inserting the chain element 4*a* into the notch 80*a* of the stopper 8, and bringing the upper surface of the regulating portion 80 of the stopper 8 into contact with the lower end of the cylindrical body 60. Therefore, the work time in the air can be shortened, and the work can be performed on the work floor 3 after the work floor 3 is installed, and the worker does not need to bend over the work floor 3, so that the floor area of the scaffolding member 10 can be expanded safely and easily.

After the joint 6 for expansion is attached to the other end of the beam member 5 for expansion, the chain 4 may be attached to the cylindrical body 60 of the expansion joint 6 via the stopper 8. Even in this case, since the cylindrical body 60 is close to the work floor 3, the worker can attach the chain 4 to the cylindrical body 60 without bending over the work floor 3. Therefore, even in this case, it is possible to safely and easily expand the floor area of the scaffolding member 10.

Finally, the end portions of the beam members 5 for expansion extending along the width direction are connected to the joints 6 and 6 for expansion attached to the other-end-side attachment pieces 54 and 54 of the two beam members 5 for expansion arranged in parallel, via the coupling pins 7. Also in these works, since the worker does not need to bend over the work floor 3, the worker can safely expand the floor area of the scaffolding member 10.

By repeating the above procedure in the depth direction or the width direction, the hanging scaffold 1 of the present embodiment can expand the floor area of the scaffolding member 10 to any position in a state of being suspended and supported by a building, a construction, or the like. The method for assembling the hanging scaffold 1 described above is an example, and is not limited to the method described above.

Figure 14:
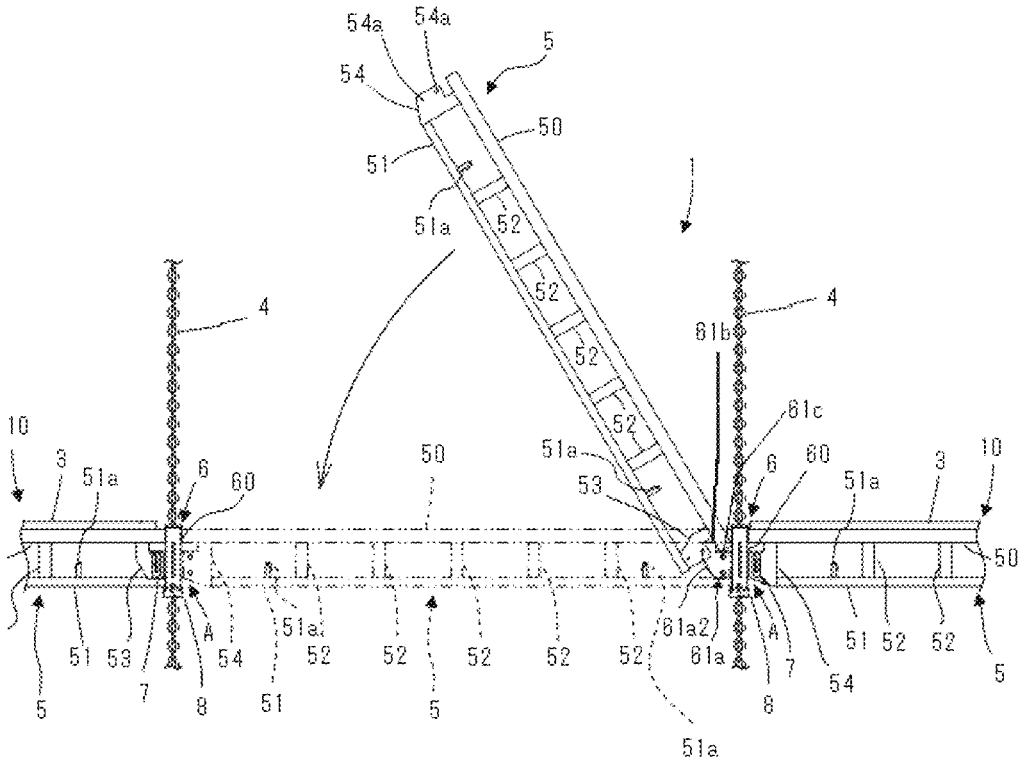
FIG. 14 is a view for explaining the method for assembling the hanging scaffold of the first embodiment, and is a view illustrating a step of bridging a beam member between joints of two hanging scaffolds.

In addition, one hanging scaffold 1 may be assembled by connecting the two existing scaffolding members 10 and 10 in the air by simultaneously assembling the two existing scaffolding members 10 and 10 in the air and bridging the beam member 5 for expansion between the joints 6 and 6 facing each other of the two existing scaffolding members 10 and 10. Specifically, as illustrated in FIG. 14, the upper beam material 50 of the beam member 5 for expansion is inserted into the recessed portion 61*c* of the plate 61 of the joint 6 of one scaffolding member 10 of the two existing scaffolding members 10 and 10 on the right side in the drawing in a posture along the vertical direction with one end the upper beam material 50 facing downward, and is tilted toward the joint 6 side of the other scaffolding member 10 on the left side in the drawing. Here, as described above, since the lower ends of the pair of other-end-side attachment pieces 54 and 54 provided on the other end side of the beam member 5 of the present embodiment are connected to the other end surface of the lower beam material 51, the lower side of the gap between the other-end-side attachment pieces 54 and 54 is open. Therefore, when the upper beam material 50 of the beam member 5 for expansion is tilted toward the other scaffolding member 10 side, the upper beam material 50 of the beam member 5 for expansion covers and abuts on the upper end of the plate 61 of the joint 6 of the other scaffolding member 10 from above, and the plate 61 is fitted between the other-end-side attachment pieces 54 and 54. Thereafter, the end portions of the beam members 5 for expansion are connected to the joints 6 via the coupling pins 7 from the work floors 3 of both the scaffolding members 10 and 10, whereby the beam members 5 for expansion can be bridged and connected between the joint 6 of one scaffolding member 10 and the joint 6 of the other scaffolding member 10.

Although not illustrated, the two scaffolding members 10 and 10 can be connected in the air by bridging the beam member 5 for expansion between the two joints 6 and 6 arranged in parallel of one scaffolding member 10 and the two joints 6 and 6 arranged in parallel of the other scaffolding member 10 in the above procedure, and bridging the plurality of scaffold boards 3*a* between the two beam members 5 and 5 for expansion to install the work floor 3. In this way, when two scaffolding members 10 and 10 are connected in the air to assemble one hanging scaffold 1, the hanging scaffold 1 having a large floor board area can be assembled in a short time.

In the present embodiment, the gap between the other-end-side attachment pieces 54 and 54 provided on the other end side of the beam member 5 is opened downward so that the beam member 5 for expansion can be bridged between the joints 6 and 6 of the two scaffolding members 10 and 10. However, in a case where use in such an application is not assumed, the gap between the other-end-side attachment pieces 54 and 54 may be closed by the lower beam material 51 similarly to the gap between the one-end-side attachment pieces 53 and 53. In this way, since the structures on one end side and the other end side of the beam member 5 are the same, it is possible to prevent the occurrence of an erroneous combination.

As described above, the hanging scaffold 1 of the present embodiment includes: the scaffolding member 10 having the work floor 3; the chain 4 formed by connecting a plurality of annular-shaped chain elements 4*a* in a row and suspending the scaffolding member 10; and the chain coupling device A installed in the scaffolding member 10 and coupling the chain 4 to the scaffolding member 10, in which when a side facing the hole of the chain element 4*a* is a front side, a width of the chain element 4*a* viewed from the front side is a lateral width, and a width of the chain element 4*a* viewed from a side is a vertical width, the chain coupling device A includes: the cylindrical body 60 in which an axis is along the vertical direction and the chain 4 is inserted inside; and the stopper 8 that has the notch 80*a* with a width narrower than the lateral width of the chain element 4*a* and wider than the vertical width of the chain element 4*a* and abuts on the lower end of the cylindrical body 60.

In the hanging scaffold 1 configured as described above, the chain 4 can be connected to the cylindrical body 60 simply by slidingly moving the stopper 8 in the lateral direction toward the chain 4 side, inserting the chain element 4*a* located below the lower end of the cylindrical body 60 into the notch 80*a* of the stopper 8, and pulling up the chain 4. Therefore, it is not necessary to adjust the orientation of the chain element 4*a* and the position of the hole so as to have the same height and the same direction as the position of the through hole of the cylindrical body, and thus the chain 4 can be easily connected to the scaffolding member 10, as compared with the conventional case where the chain is connected to the cylindrical body by adjusting the position and orientation of the hole of the chain element of the chain inserted into the cylindrical body so as to face the through hole provided in the cylindrical body and then inserting the pin into the hole of the chain element and the through hole.

In addition, in the conventional hanging scaffold, the load of a scaffolding member and the load of a load loaded on the scaffolding member act on a pin connecting the chain and the cylindrical body. At this time, since the load concentrates on the portion of the pin inserted into the through hole provided in the cylindrical body, it is necessary to increase the strength of the pin as the load increases. However, the diameter of the pin is limited to the size of the pin passing through the hole of the chain element, and when the diameter of the pin is increased, the diameter of the cylindrical body also needs to be increased, and there is a limit to increase the strength of the pin. Therefore, in the conventional hanging scaffold, it is difficult to increase the maximum loading load.

On the other hand, in the hanging scaffold 1 of the present embodiment, since the upper surface of the stopper 8 of the chain coupling device A supports the cylindrical body 60 by bringing into contact with the lower end of the cylindrical body 60, the stopper 8 can ensure sufficient strength without being limited by the size of the hole of the chain element 4*a*, and thus can ensure necessary strength according to the loading load required for the hanging scaffold 1. Therefore, according to the hanging scaffold 1 of the present embodiment, the maximum loading load of the hanging scaffold 1 can be increased, and the number of chains 4 can also be reduced.

In the hanging scaffold 1 of the present embodiment, the stopper 8 includes the fitting portion 81 that is fitted to the lower end of the cylindrical body 60 in the vertical direction. In the hanging scaffold 1 configured as described above, when the lower end of the cylindrical body 60 is fitted to the fitting portion 81, the movement of the stopper 8 in the lateral direction with respect to the cylindrical body 60 is restricted, so that the stopper 8 can be prevented from falling off the chain 4. However, the fitting portion 81 may be omitted.

In addition, in the hanging scaffold 1 of the present embodiment, the outer periphery of the lower end of the cylindrical body 60 is fitted inside the fitting portion 81, and the chain coupling device A includes the pressing means 82 provided at the upper end of the fitting portion 81 and capable of moving toward and away from the outer periphery of the cylindrical body 60. According to the hanging scaffold 1 configured as described above, when the pressing means 82 is brought close to the outer periphery of the cylindrical body 60 to press the outer periphery of the cylindrical body 60 from the lateral direction, even if the inner diameter of the fitting portion 81 is slightly larger than the design and there is a gap between the inner periphery of the fitting portion 81 and the outer periphery of the cylindrical body 60, the outer periphery of the cylindrical body 60 is pressed against the inner periphery of the fitting portion 81, so that the stopper 8 cannot move in the lateral direction. Therefore, it is possible to prevent the stopper 8 from rattling in the lateral direction without strictly controlling the dimensions of the fitting portion 81. However, in a case where slight rattling of the stopper 8 in the lateral direction is allowed, the pressing means 82 may be omitted.

In addition, in the hanging scaffold 1 of the present embodiment, the stopper 8 includes a regulating portion 80 that abuts on the lower end of the cylindrical body 60, and the regulating portion 80 has a disk shape and includes the notch 80*a* that opens from the upper end side and a semicircular recessed portion 80*b* that opens from the lower end side and communicates with the notch 80*a* and can accommodate the upper portion of the chain element 4*a*. According to the hanging scaffold 1 configured as described above, even if the thickness of the entire regulating portion 80 is set to be equal to or larger than the size of the gap between the lateral chain elements 4*a* and 4*a* adjacent to each other, the thickness of the portion of the regulating portion 80 around the notch 80*a* can be reduced. Therefore, in the stopper 8 of the present embodiment, it is possible to secure the thickness of the other portion of the regulating portion 80 while allowing the portion around the notch 80*a* in the regulating portion 80 to be inserted between the lateral chain elements 4*a* and 4*a*, and thus, the stopper 8 can obtain sufficient strength.

The recessed portion 80*b* of the present embodiment is formed in a semicircular shape having a size corresponding to the upper portion of the chain element 4*a* of the chain 4. Therefore, in a state where the chain element 4*a* is inserted into the notch 80*a*, the upper end of the lower chain element 4*a* connected to the lower end of the vertical chain element 4*a* inserted into the notch 80*a* is fitted into the recessed portion 80*b*. Therefore, sitting of the chain element 4*a* in the recessed portion 80*b* is improved, abrasion of the upper end of the chain element 4*a* can be suppressed, and the scaffolding member 10 can be stably suspended by the chain 4. However, the size of the recessed portion 80*b* may not be the same size as the upper portion of the chain element 4*a* as long as the recessed portion is large enough to accommodate the upper portion of the chain element 4*a*.

In addition, if the strength of the stopper 8 is not insufficient, the entire thickness of the regulating portion 80 may be made smaller than the size of the gap between the lateral chain elements 4*a* and 4*a* adjacent to each other. In this case, the recessed portion 80*b* is omitted.

In the present embodiment, the regulating portion 80 is formed in a disk shape, but the shape of the regulating portion 80 is not particularly limited as long as the upper surface can abut on the lower end of the cylindrical body 60.

In the hanging scaffold 1 of the present embodiment, the scaffolding member 10 includes the plurality of beam members 5 arranged in parallel, the joint 6 connected to end portions of the beam members 5, and the work floor 3 installed between the beam members 5 and 5, and the chain coupling device A is provided in the joint 6.

According to the hanging scaffold 1 configured as described above, since the chain coupling device A is provided in the joint 6 connected to the end portion of the beam member 5 of the scaffolding member 10, the number of parts of the hanging scaffold 1 can be reduced. However, the chain coupling device A may be provided in a portion other than the joint 6 of the scaffolding member 10, for example, the cylindrical body 60 may be provided in the beam member 5, and the chain 4 may be connected to the cylindrical body 60 via the stopper 8.

Next, the hanging scaffold 1 of a second embodiment will be described. The configuration of the hanging scaffold 1 of the second embodiment is different from the configuration of the hanging scaffold 1 of the first embodiment only in that the chain 4 is coupled to the scaffolding member 10 using another chain coupling device A1 instead of the chain coupling device A. The common configurations are denoted by the same reference numerals, and a detailed description thereof will be omitted.

In the chain coupling device A of the first embodiment, the stopper 8 supports the cylindrical body 60 by bringing the upper surface of the regulating portion 80 of the stopper 8 into contact with the lower end of the cylindrical body 60, whereas in the chain coupling device A1 of the second embodiment, the chain 4 can be connected to the joint 6 of the scaffolding member 10 by attaching a stopper 9 to the upper end of the cylindrical body 60.

Figure 15:
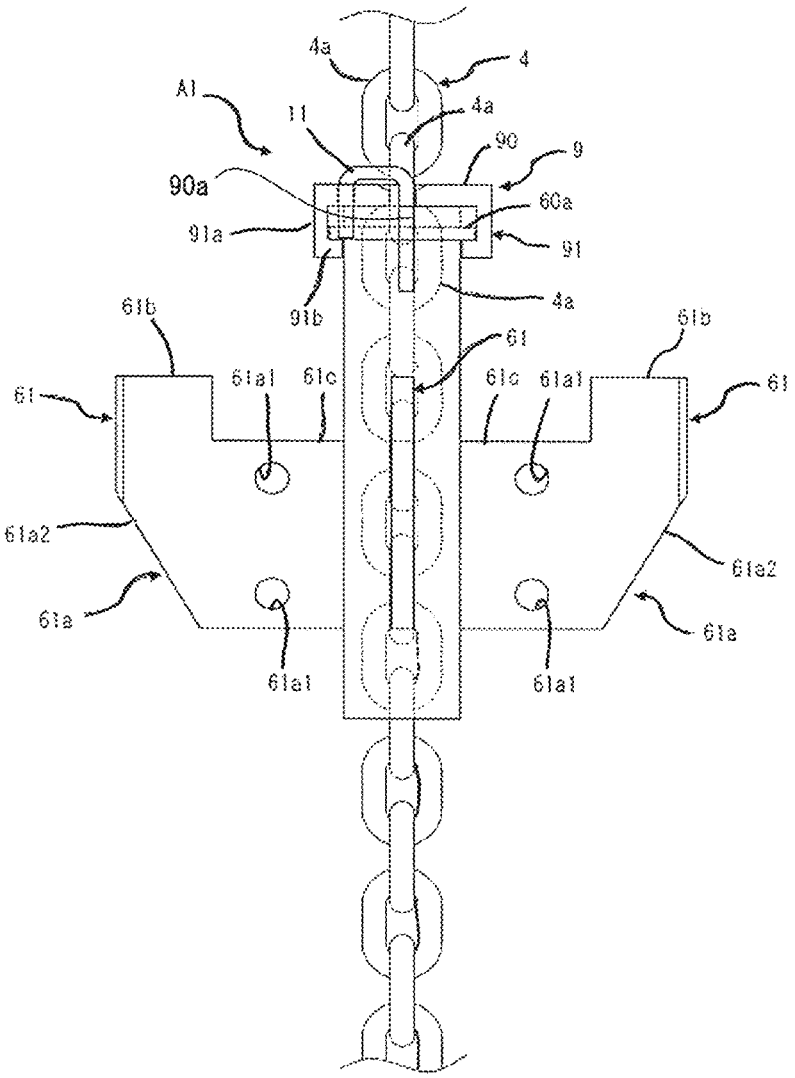
FIG. 15 is an enlarged side view illustrating the chain coupling device in the hanging scaffold of a second embodiment.
Figure 16:
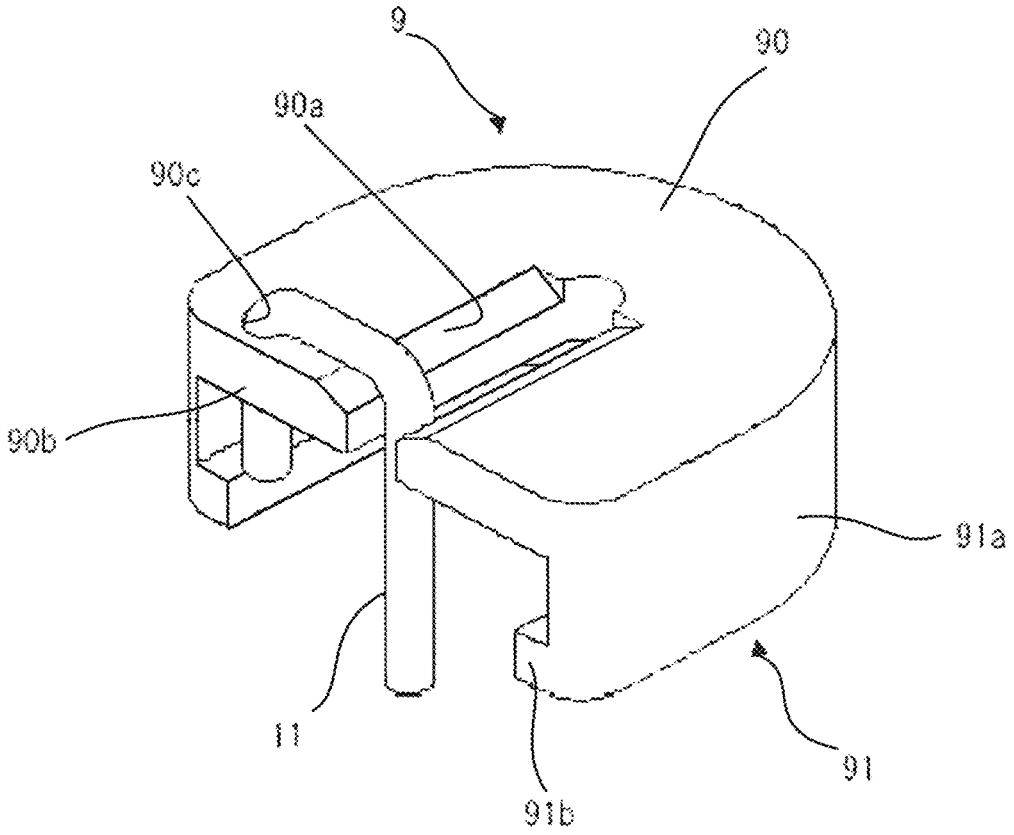
FIG. 16 is an enlarged perspective view illustrating a stopper of the chain coupling device in the hanging scaffold of the second embodiment.

Specifically, as illustrated in FIGS. 15 and 16, the chain coupling device A1 according to the second embodiment includes the cylindrical body 60 into which the chain 4 is inserted, a regulating portion 90 having a notch 90*a* having a width narrower than the lateral width of the chain element 4*a* and wider than the vertical width of the chain element 4*a*, and a connecting means that connects the regulating portion 90 in a state of regulating movement in the vertical direction while allowing the lateral movement with respect to the upper end of the cylindrical body 60. As illustrated in FIG. 15, the connecting means includes an annular-shaped protruding portion 60*a* provided on an outer periphery of the upper end of the cylindrical body 60, and a hook portion 91 provided at a lower end of the regulating portion 90 and capable of being hooked on the lower end of the protruding portion 60*a*. Also, in FIG. 15, an illustration of the beam member 5 is omitted for easy understanding of the configuration of the chain coupling device A1. In the chain coupling device A of the first embodiment, since the chain 4 is connected to the cylindrical body 60 by bringing the upper surface of the regulating portion 80 of the stopper 8 into contact with the lower end of the cylindrical body 60, the protruding portion 60*a* can be omitted.

Hereinafter, each part of the chain coupling device A1 will be described in detail. The stopper 9 of the present embodiment includes the regulating portion 90 and the hook portion 91 provided at the lower end of the regulating portion 90. As illustrated in FIG. 16, the regulating portion 90 has a D-shaped plate shape, and includes the notch 90*a* formed by being cut out in a rectangular shape from the center of a straight portion 90*b* to a position slightly beyond the center of the regulating portion 90. The width of the notch 90*a* in the lateral direction (hereinafter, simply referred to as a "width of the notch 90*a*") when the stopper 9 is viewed from the side is set to be narrower than the lateral width of the chain element 4*a* and wider than the vertical width of the chain element 4*a*. In addition, an insertion hole 90*c* penetrating the regulating portion 90 in the vertical direction (thickness direction) is provided in the vicinity of the straight portion 90*b* side of the regulating portion 90.

The hook portion 91 includes a peripheral wall portion 91*a* having a U-shaped cross section and protruding downward from a portion other than the straight portion 90*b* of the peripheral edge of the regulating portion 90, and a U-shaped contact portion 91*b* protruding inward from a lower end of the peripheral wall portion 91*a*. The distance between the lower end of the regulating portion 90 and an upper end of the contact portion 91*b* is equal to or larger than the thickness in the vertical direction of the annular-shaped protruding portion 60*a* provided on the outer periphery of the upper end of the cylindrical body 60.

In the stopper 9 configured as described above, in a state where the gap between the lower end of the regulating portion 90 and the contact portion 91*b* of the hook portion 91 faces the protruding portion 60*a* of the cylindrical body 60 in the horizontal direction, the stopper 9 can be slidingly moved in the lateral direction to insert the protruding portion 60*a* into the gap between the lower end of the regulating portion 90 and the contact portion 91*b* of the hook portion 91. When the protruding portion 60*a* is inserted into the gap between the lower end of the regulating portion 90 and the contact portion 91*b* of the hook portion 91 in this manner, the protruding portion 60*a* is sandwiched between the lower end of the regulating portion 90 and the contact portion 91*b* of the hook portion 91, so that the stopper 9 is connected to the upper end of the cylindrical body 60 in a state where the movement in the vertical direction is restricted.

Furthermore, since the width of the notch 90*a* is wider than the width of the vertical chain element 4*a*, when the stopper 9 is slidingly moved in the lateral direction to connect the stopper 9 to the protruding portion 60*a* of the cylindrical body 60, the vertical chain element 4*a* located near the upper end of the cylindrical body 60 in the chain 4 inserted into the cylindrical body 60 can be inserted into the notch 90*a*. Therefore, since the width of the notch 90*a* is narrower than the width of the lateral chain element 4*a*, the notch 90*a* does not allow the two lateral chain elements 4*a* and 4*a* connected above and below the vertical chain element 4*a* inserted into the notch 90*a* to pass in the vertical direction when the vertical chain element 4*a* is inserted into the notch 90*a*. That is, the notch 90*a* allows the chain 4 to be inserted from the lateral direction, but does not allow the chain 4 inserted inside to move in the vertical direction. Therefore, when the vertical chain element 4*a* is inserted into the notch 90*a* of the regulating portion 90, the stopper 9 is connected to the chain 4 in a state where the vertical movement is regulated.

As illustrated in FIGS. 15 and 16, the chain coupling device A1 includes a retaining pin 11 that has a J-shape, has one end that is a shorter end portion inserted into the insertion hole 90*c* provided in the regulating portion 90, and has the other end that is a longer end portion inserted into the cylindrical body 60 through the notch 90*a*. As illustrated in FIG. 15, in a state where the stopper 9 is attached to the upper end of the cylindrical body 60 and the chain 4 is inserted into the notch 90*a* of the regulating portion 90, when each end portion of the retaining pin 11 is inserted into the insertion hole 90*c* and the cylindrical body 60, even if the stopper 9 is laterally moved to be removed from the cylindrical body 60, the chain 4 inserted into the cylindrical body 60 comes into contact with the retaining pin 11 and cannot come out of the notch 90*a*. Therefore, since the movement of the stopper 9 in the lateral direction is restricted by the retaining pin 11, the stopper 9 can be prevented from falling off from the cylindrical body 60.

In addition, since the length of the retaining pin 11 on the one end side, which is the shorter side, is set to a length that does not interfere with the upper end of the protruding portion 60*a* of the cylindrical body 60 when the retaining pin 11 is inserted into the insertion hole 90*c*, the retaining pin 11 does not float due to the one end of the retaining pin 11 interfering with the upper end of the protruding portion 60*a*. However, as long as one end of the retaining pin 11 does not come out of the insertion hole 90*c*, the length on one end side of the retaining pin 11 may be such a length that one end of the retaining pin 11 interferes with the upper end of the protruding portion 60*a*.

In addition, since the retaining pin 11 is formed in a J-shape by bending a linear metal rod, a bent portion of the retaining pin 11 is curved in a circular arc shape. Therefore, the inner side of the bent portion of the retaining pin 11 has a shape that enters the inner side as compared with the case where the bent portion of the retaining pin 11 is entirely bent at a right angle. On the other hand, in the present embodiment, as illustrated in FIG. 16, by chamfering the upper corner of the notch 90*a*, the circular-arc-shaped bent portion of the retaining pin 11 interferes with the upper corner of the notch 90*a*, and the retaining pin 11 is prevented from rising. However, the upper corner of the notch 90*a* may not be chamfered as long as the retaining pin 11 does not interfere with the upper corner of the notch 90*a*.

Although the retaining pin 11 is formed in a J-shape in the drawing, the retaining pin 11 may be formed in a U-shape as long as the other end of the retaining pin 11 can be inserted into the cylindrical body 60 via the notch 90*a* in a state where one end of the retaining pin 11 is inserted into the insertion hole 90*c*. However, the retaining pin 11 may be omitted.

Next, a procedure for connecting the chain 4 to the cylindrical body 60 by the chain coupling device A1 will be described. First, the chain 4 is inserted into the cylindrical body 60. Thereafter, the stopper 9 is slidingly moved in the lateral direction to insert the protruding portion 60*a* of the cylindrical body 60 into the peripheral wall portion 91*a* of the hook portion 91 while inserting the vertical chain element 4*a* located near the upper end of the cylindrical body 60 into the notch 90*a* of the regulating portion 90. In this state, when the stopper 9 is suspended by the chain 4, the stopper 9 is lifted upward by the chain 4, the lower end of the protruding portion 60*a* abuts on the contact portion 91*b* of the hook portion 91, and the hook portion 91 is hooked by the protruding portion 60*a*. Then, since the cylindrical body 60 is supported by the stopper 9, the scaffolding member 10 is suspended and supported by the chain 4.

Finally, when each end portion of the retaining pin 11 is inserted into the cylindrical body 60 via the insertion hole 90*c* and the notch 90*a* provided in the regulating portion 90, the stopper 9 is restricted from moving in the lateral direction by the retaining pin 11, so that the stopper 9 can be prevented from falling off from the cylindrical body 60.

In the present embodiment, the regulating portion 90 is formed in a D-shaped plate shape, but the shape of the regulating portion 90 is not particularly limited, and may be, for example, a disk shape. Further, in the present embodiment, the notch 90*a* is formed in a rectangular shape and has a constant lateral width. As described above, the lateral width of the notch 90*a* is wider than the vertical width of the chain element 4*a* and narrower than the lateral width of the chain element 4*a*. Therefore, in the present embodiment, the entire width of the notch 90*a* is wider than the vertical width of the chain element 4*a* and narrower than the lateral width of the chain element 4*a*, but the width of the other portion of the notch 90*a* may be wider than the vertical width of the chain element 4*a* as long as the width of at least a part of the notch 90*a* is wider than the vertical width of the chain element 4*a* and narrower than the lateral width of the chain element 4*a*. However, as in the present embodiment, when the entire width of the notch 90*a* is wider than the vertical width of the chain element 4*a* and narrower than the lateral width of the chain element 4*a*, the stopper 9 does not fall off from the chain 4 even if the chain 4 is slightly displaced in the lateral direction with respect to the stopper 9.

In the chain coupling device A1 according to the second embodiment, after the chain 4 is inserted into the cylindrical body 60, the stopper 9 is slidingly moved in the lateral direction toward the cylindrical body 60, the protruding portion 60*a* provided at the upper end of the cylindrical body 60 is inserted into the gap between the lower end of the regulating portion 90 and the contact portion 91*b* of the hook portion 91, the vertical chain element 4*a* located near the upper end of the cylindrical body 60 is inserted into the notch 90*a* of the regulating portion 90, and the hook portion 91 is hooked on the protruding portion 60*a*, so that the chain 4 can be connected to the cylindrical body 60. Therefore, in the chain coupling device A1 according to the present embodiment, it is not necessary to adjust the orientation of the chain element 4*a* and the position of the hole so as to have the same height and the same direction as the position of the through hole of the cylindrical body, and thus the chain 4 can be easily connected to the scaffolding member 10, as compared with the conventional case where the chain is connected to the cylindrical body by adjusting the position and orientation of the hole of the chain element of the chain inserted into the cylindrical body so as to face the through hole provided in the cylindrical body and then inserting the pin into the hole of the chain element and the through hole.

In addition, in the chain coupling device A of the hanging scaffold 1 of the first embodiment, when the chain 4 is connected to the cylindrical body 60 of the joint 6, it is necessary to bring the upper surface of the regulating portion 80 of the stopper 8 into contact with the lower end of the cylindrical body 60. Therefore, in the work of expanding the floor area of the scaffolding member 10, when the chain 4 is to be attached to the joint 6 for expansion after the joint 6 for expansion is attached to the other end of the beam member 5 for expansion, the work position at which the stopper 8 is attached to the cylindrical body 60 is lower than the lower end of the cylindrical body 60.

On the other hand, in the chain coupling device A1 of the hanging scaffold 1 of the second embodiment, the stopper 9 is attached to the protruding portion 60*a* provided at the upper end of the cylindrical body 60. Therefore, in the work of expanding the floor area of the scaffolding member 10, when the chain 4 is to be attached to the joint 6 for expansion after the joint 6 for expansion is attached to the other end of the beam member 5 for expansion, the work position at which the stopper 9 is attached to the cylindrical body 60 is the upper end of the cylindrical body 60. Therefore, the work position of the chain coupling device A1 of the second embodiment is closer to the work floor 3 than the work position of the chain coupling device A of the first embodiment in which the work position at which the stopper 8 is attached to the cylindrical body 60 is below the cylindrical body 60. Therefore, in the chain coupling device A1 of the second embodiment, the work of attaching the joint 6 for expansion to the other end of the beam member 5 for expansion and then attaching the chain 4 to the joint 6 for expansion can be performed more safely and easily than the chain coupling device A of the first embodiment.

In addition, as described above, in the conventional hanging scaffold, the load of a scaffolding member and the load of a load loaded on the scaffolding member act on a pin connecting the chain and the cylindrical body. At this time, since the load concentrates on the portion of the pin inserted into the through hole provided in the cylindrical body, it is necessary to increase the strength of the pin as the load increases. However, the diameter of the pin is limited to the size of the pin passing through the hole of the chain element, and when the diameter of the pin is increased, the diameter of the cylindrical body also needs to be increased, and there is a limit to increase the strength of the pin. Therefore, in the conventional hanging scaffold, it is difficult to increase the maximum loading load.

On the other hand, in the chain coupling device A1 of the second embodiment, the load of the scaffolding member 10 and the load of the load loaded on the scaffolding member 10 is received by the contact portion 91*b* of the hook portion 91 abutting on the lower end of the annular-shaped protruding portion 60*a* provided on the outer periphery of the upper end of the cylindrical body 60. Since the hook portion 91 is disposed on the outer peripheral side of the cylindrical body 60 and supports the protruding portion 60*a* of the cylindrical body 60, the thickness and dimension of the hook portion 91 are not limited. Therefore, the strength of the hook portion 91 can be secured by increasing the thickness of the peripheral wall portion 91*a* and the contact portion 91*b*. Therefore, according to the hanging scaffold 1 of the second embodiment, the maximum loading load of the hanging scaffold 1 can be increased, and the number of chains 4 can also be reduced.

In the present embodiment, the protruding portion 60*a* is formed such that the outer diameter of the outer periphery of the upper end of the cylindrical body 60 is larger than that of the other portion. However, a small-diameter portion having an outer diameter smaller than that of the other portion may be provided in a part of the cylindrical body 60, and the upper side of the small-diameter portion in the cylindrical body 60 may be used as the protruding portion 60*a*. In the present embodiment, the protruding portion 60*a* is formed in an annular shape, but the protruding portion 60*a* may be formed in a shape other than the annular shape as long as it can hook the hook portion 91.

As described above, the hanging scaffold 1 of the second embodiment includes: the scaffolding member 10 having the work floor 3; the chain 4 formed by connecting a plurality of annular-shaped chain elements 4*a* in a row and suspending the scaffolding member 10; and the chain coupling device A1 installed in the scaffolding member 10 and coupling the chain 4 to the scaffolding member 10, in which when a side facing a hole of the chain element 4*a* is a front side, a width of the chain element 4*a* viewed from the front side is a lateral width, and a width of the chain element 4*a* viewed from a side is a vertical width, the chain coupling device A1 includes: the cylindrical body 60 in which an axis is along the vertical direction and the chain 4 is inserted inside; the regulating portion 90 having the notch 90*a* with a width narrower than the lateral width of the chain element 4*a* and wider than the vertical width of the chain element 4*a*; and the connecting means that connects the regulating portion 90 in a state of regulating movement in the vertical direction while allowing the lateral movement with respect to the upper end of the cylindrical body 60.

According to the hanging scaffold 1 configured as described above, since the notch 90*a* allows insertion of the chain 4 from the lateral direction, but does not allow movement of the chain 4 inserted inside in the vertical direction, when the chain element 4*a* is inserted into the notch 90*a*, the stopper 9 is connected to the chain 4. Therefore, the chain 4 can be connected to the cylindrical body 60 simply by slidingly moving the stopper 9 in the lateral direction toward the cylindrical body 60, connecting the regulating portion 90 to the upper end of the cylindrical body 60 by the connecting means, and inserting the chain element 4*a* located near the upper end of the cylindrical body 60 into the notch 90*a*. Therefore, in the chain coupling device A1, it is not necessary to adjust the orientation of the chain element 4*a* and the position of the hole so as to have the same height and the same direction as the position of the through hole of the cylindrical body, and thus the chain 4 can be easily connected to the scaffolding member 10, as compared with the conventional case where the chain is connected to the cylindrical body by adjusting the position and orientation of the hole of the chain element of the chain inserted into the cylindrical body so as to face the through hole provided in the cylindrical body and then inserting the pin into the hole of the chain element and the through hole.

In addition, in the chain coupling device A1 of the second embodiment, since the regulating portion 90 is connected to the upper end of the cylindrical body 60 by the connecting means, when the floor area of the scaffolding member 10 is expanded, since the work position for attaching the chain 4 to the cylindrical body 60 is close to the work floor 3, the work for expanding the floor area of the scaffolding member 10 can be safely and easily performed.

In addition, in the hanging scaffold 1 of the second embodiment, the connecting means includes the protruding portion 60*a* provided on the outer periphery of the upper end of the cylindrical body, and the hook portion 91 provided at the lower end of the regulating portion 90 and capable of being hooked on the lower end of the protruding portion 60*a*.

In the hanging scaffold 1 configured as described above, the chain 4 can be connected to the cylindrical body 60 simply by slidingly moving the stopper 9 in the lateral direction toward the cylindrical body 60 to insert the chain element 4*a* located near the upper end of the cylindrical body 60 into the notch 90*a* and by hooking the hook portion 91 on the protruding portion 60*a*. Therefore, the chain 4 can be more easily connected to the scaffolding member 10.

Furthermore, in the hanging scaffold 1 configured as described above, the load of the scaffolding member 10 and the load of the load loaded on the scaffolding member 10 is received by the contact portion 91*b* of the hook portion 91 abutting on the lower end of the protruding portion 60*a* provided on the outer periphery of the upper end of the cylindrical body 60. However, since the hook portion 91 is arranged on the outer peripheral side of the cylindrical body 60 and supports the protruding portion 60*a* of the cylindrical body 60, the wall thickness and dimension of the hook portion 91 are not limited. Therefore, the strength of the hook portion 91 can be secured by increasing the thickness and dimension of the hook portion 91. Therefore, according to the hanging scaffold 1 configured as described above, the maximum loading load of the hanging scaffold 1 can be increased, and the number of chains 4 can also be reduced.

In addition, in the hanging scaffold 1 of the second embodiment, the protruding portion 60*a* has an annular shape, and the hook portion 91 includes the peripheral wall portion 91*a* having a U-shaped cross section and protruding downward from the lower end of the regulating portion 90, and the U-shaped contact portion 91*b* protruding inward from the lower end of the peripheral wall portion 91*a* and abutting on the lower end of the protruding portion 60*a*.

According to the hanging scaffold 1 configured as described above, the strength of the hook portion 91 can be secured by increasing the thickness of the peripheral wall portion 91*a* and the contact portion 91*b*. Therefore, the maximum loading load of the hanging scaffold 1 can be increased, and the number of chains 4 can also be reduced.

However, the protruding portion 60*a* may have a shape other than the annular shape as long as it protrudes from the outer periphery of the upper end of the cylindrical body 60 so that the hook portion 91 can be hooked. In addition, the shape of the hook portion 91 is not particularly limited as long as it can be hooked to the lower end of the protruding portion 60*a*, and for example, the hook portion 91 may be configured by a pair of hooks facing each other on an outer periphery of the regulating portion 90.

In the chain coupling device A1 according to the second embodiment, the connecting means for connecting the stopper 9 to the upper end of the cylindrical body 60 includes the annular-shaped protruding portion 60*a* provided on the outer periphery of the upper end of the cylindrical body 60 and the hook portion 91 provided at the lower end of the regulating portion 90 and capable of being hooked on the lower end of the protruding portion 60*a*. However, such a configuration of the connecting means is an example, and the connecting means is not particularly limited as long as the stopper 9 can be slidingly moved in the lateral direction to be connected to the upper end of the cylindrical body 60.

In the hanging scaffold 1 of the second embodiment, the chain coupling device A1 includes the retaining pin 11 having a J-shape or a U-shape, one end of which is inserted into the insertion hole 90*c* provided in the regulating portion 90, and the other end of which is inserted into the cylindrical body 60 through the notch 90*a*.

In the hanging scaffold 1 configured as described above, in a state where the stopper 9 is attached to the upper end of the cylindrical body 60, when each end portion of the retaining pin 11 is inserted into the insertion hole 90*c* and the cylindrical body 60, even if the stopper 9 is laterally moved to be removed from the cylindrical body 60, the chain 4 inserted into the cylindrical body 60 comes into contact with the retaining pin 11 and cannot come out of the notch 90*a*. Therefore, since the movement of the stopper 9 in the lateral direction is restricted by the retaining pin 11, the stopper 9 can be prevented from falling off from the cylindrical body 60. However, the retaining pin 11 may be omitted.

In the hanging scaffold 1 of the second embodiment, the scaffolding member 10 includes the plurality of beam members 5 arranged in parallel, the joint 6 connected to end portions of the beam members 5, and the work floor 3 installed between the beam members 5 and 5, and the chain coupling device A is provided in the joint 6.

According to the hanging scaffold 1 configured as described above, since the chain coupling device A1 is provided in the joint 6 connected to the end portion of the beam member 5 of the scaffolding member 10, the number of parts of the hanging scaffold 1 can be reduced. However, the chain coupling device A1 may be provided in a portion other than the joint 6 of the scaffolding member 10, for example, the cylindrical body 60 may be provided in the beam member 5, and the chain 4 may be connected to the cylindrical body 60 via the stopper 8.

Although the preferred embodiments of the present invention have been described in detail above, it is obvious that modifications, variations, and changes can be made without departing from the scope of the claims.

What is claimed is:

1. A hanging scaffold comprising:

a scaffolding member having a work floor;

a chain formed by connecting a plurality of annular-shaped chain elements in a row and suspending the scaffolding member; and a chain coupling device installed in the scaffolding member and coupling the chain to the scaffolding member, wherein when a side facing a hole of the chain element is a front side, a width of the chain element viewed from the front side is a lateral width, and a width of the chain element viewed from a side is a vertical width, the chain coupling device includes:

a cylindrical body in which an axis is along a vertical direction and the chain is inserted inside;

a regulating portion having a notch with a width narrower than the lateral width of the chain element and wider than the vertical width of the chain element; and a connecting means that connects the regulating portion with respect to an upper end of the cylindrical body, and the regulating portion is, in a state where the regulating portion is connected to the upper end of the cylindrical body by the connecting means, allowed a lateral movement with respect to the cylindrical body and is regulated movement in a vertical direction with respect to the cylindrical body.

2. The hanging scaffold according to claim 1, wherein the connecting means includes a protruding portion provided on an outer periphery of the upper end of the cylindrical body, and a hook portion provided at a lower end of the regulating portion and capable of being hooked on a lower end of the protruding portion.

3. The hanging scaffold according to claim 2, wherein the protruding portion has an annular shape, and the hook portion includes a peripheral wall portion having a U-shaped cross section and protruding downward from the lower end of the regulating portion, and a U-shaped contact portion protruding inward from a lower end of the peripheral wall portion and abutting on the lower end of the protruding portion.

4. The hanging scaffold according to claim 1, wherein the chain coupling device includes a retaining pin having a J-shape or a U-shape, one end of which is inserted into an insertion hole provided in the regulating portion, and an other end of which is inserted into the cylindrical body through the notch.

5. A hanging scaffold comprising:

a scaffolding member having a work floor;

a chain formed by connecting a plurality of annular-shaped chain elements in a row and suspending the scaffolding member; and a chain coupling device installed in the scaffolding member and coupling the chain to the scaffolding member, wherein when a side facing a hole of the chain element is a front side, a width of the chain element viewed from the front side is a lateral width, and a width of the chain element viewed from a side is a vertical width, the chain coupling device includes:

a cylindrical body in which an axis is along a vertical direction and the chain is inserted inside; and a stopper that has a notch with a width narrower than the lateral width of the chain element and wider than the vertical width of the chain element and abuts on a lower end of the cylindrical body, the stopper includes a fitting portion that is fitted to a lower end of the cylindrical body in the vertical direction, an outer periphery of the lower end of the cylindrical body is fitted inside the fitting portion, and the chain coupling device includes a pressing means that is provided at an upper end of the fitting portion and is movable toward and away from the outer periphery of the cylindrical body.

* * * * *